US009393778B2

(12) United States Patent
Sato et al.

(10) Patent No.: US 9,393,778 B2
(45) Date of Patent: Jul. 19, 2016

(54) IMAGE FORMING DEVICE AND DOT PATTERN DETERMINING METHOD

(71) Applicant: SEIKO EPSON CORPORATION, Tokyo (JP)

(72) Inventors: Akito Sato, Nagano (JP); Naoki Sudo, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/604,890

(22) Filed: Jan. 26, 2015

(65) Prior Publication Data

US 2015/0224761 A1 Aug. 13, 2015

(30) Foreign Application Priority Data

Feb. 13, 2014 (JP) ..... 2014-025386

(51) Int. Cl.

| | |
|---|---|
| ***B41J 29/38*** | (2006.01) |
| ***B41J 2/045*** | (2006.01) |
| ***B41J 2/21*** | (2006.01) |
| *B41J 2/14* | (2006.01) |

(52) U.S. Cl.

CPC ..... *B41J 2/04505* (2013.01); *B41J 2/0451* (2013.01); *B41J 2/04581* (2013.01); *B41J 2/2139* (2013.01); *B41J 2/2146* (2013.01); *B41J 2002/14354* (2013.01)

(58) Field of Classification Search

CPC .... B41J 2/0458; B41J 2/04563; B41J 29/393; B41J 2/2132; B41J 2/2139; G06K 15/02

USPC ..... 347/14

See application file for complete search history.

(56) References Cited

U.S. PATENT DOCUMENTS

| | | | | |
|---|---|---|---|---|
| 6,460,963 | B1 * | 10/2002 | Endo | B41J 2/2139 347/19 |
| 6,575,549 | B1 * | 6/2003 | Silverbrook | B41J 2/2139 347/14 |
| 7,192,112 | B2 | 3/2007 | Nakanishi et al. | |
| 7,585,038 | B2 * | 9/2009 | Shibata | B41J 2/5056 347/12 |
| 2002/0051144 | A1 * | 5/2002 | Ilbery et al. | 358/1.8 |
| 2006/0061616 | A1 * | 3/2006 | Yamazaki | 347/19 |
| 2007/0070108 | A1 * | 3/2007 | Mantell et al. | 347/19 |
| 2007/0070111 | A1 * | 3/2007 | Vladislav | 347/19 |
| 2010/0156998 | A1 * | 6/2010 | Matsumoto et al. | 347/68 |
| 2013/0278658 | A1 * | 10/2013 | Metcalfe et al. | 347/14 |

FOREIGN PATENT DOCUMENTS

| | | |
|---|---|---|
| JP | 2005-074944 A | 3/2005 |

* cited by examiner

*Primary Examiner* — Julian Huffman
*Assistant Examiner* — Sharon A Polk
(74) *Attorney, Agent, or Firm* — Global IP Counselors, LLP

(57) ABSTRACT

An image forming device includes a pattern determining unit and a pattern forming unit. When dots are formed continuously in a scan direction on a dot omission pixels within a designated range in the scan direction when according to recording data before supplementation of dots by a defective nozzle, and dots are formed continuously in the scan direction on adjacent pixels within the designated range, the pattern determining unit determines a dot pattern after supplementation formed on a plurality of pixels based on the recording data so as to perform at least one of enlarging at least a portion of dots formed on the adjacent pixels within the designated range, and arranging dots in secondary adjacent pixels within the designated range. The pattern forming unit forms the dot pattern after supplementation.

6 Claims, 20 Drawing Sheets

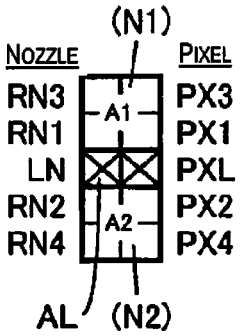

(4 ≤ Nsum ≤ 6)
(N1 ≥ N2)

0: NO DOTS
S: SMALL DOTS FORMED
M: MEDIUM DOTS FORMED
L: LARGE DOTS FORMED

TBL4 (MEDIUM INK VOLUME)

RN1 REPLACEMENT — NO RN3 REPLACEMENT, OR A PORTION REPLACED WITH 0 OR S

| LN | RN1 | → | REPLACEMENT | |
|---|---|---|---|---|
| M M | M M | → | L M | ~ 811 |
| M M | M 0 | → | L M | 813 |
| M M | 0 M | → | L M | |
| M M | 0 0 | → | M M | |
| M 0 | M M | → | L M | |
| M 0 | M 0 | → | L 0 | |
| M 0 | 0 M | → | M M | |
| M 0 | 0 0 | → | M 0 | |
| 0 M | M M | → | L M | |
| 0 M | M 0 | → | M M | |
| 0 M | 0 M | → | L 0 | |
| 0 M | 0 0 | → | 0 M | |

RN2 REPLACEMENT — NO RN4 REPLACEMENT

| LN | RN2 | → | REPLACEMENT | |
|---|---|---|---|---|
| M M | M M | → | L M | ~ 812 |
| M M | M 0 | → | M 0 | 814 |
| M M | 0 M | → | 0 M | |
| M M | 0 0 | → | 0 0 | |
| M 0 | M M | → | M M | |
| M 0 | M 0 | → | M 0 | |
| M 0 | 0 M | → | 0 M | |
| M 0 | 0 0 | → | 0 0 | |
| 0 M | M M | → | M M | |
| 0 M | M 0 | → | M 0 | |
| 0 M | 0 M | → | 0 M | |
| 0 M | 0 0 | → | 0 0 | |

(WHEN A 2 OR 3 DOT RULED LINE, MAKE DOTS OF ADJACENT PIXELS PX1 AND PX2 LARGER)

(FORM SUPPLEMENTATION DOTS IN A1 WITH MORE DOTS)

Fig. 10

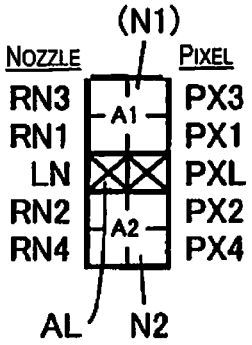

(4 ≤ Nsum ≤ 6)
(N1 < N2)

0: NO DOTS
S: SMALL DOTS FORMED
M: MEDIUM DOTS FORMED
L: LARGE DOTS FORMED

TBL5 (MEDIUM INK VOLUME)

RN1 REPLACEMENT — NO RN3 REPLACEMENT

| LN | RN1 | → | REPLACEMENT | |
|---|---|---|---|---|
| ~~M M~~ | ~~M M~~ | → | ~~M M~~ | ~ NOT POSSIBLE |
| M M | M 0 | → | M 0 | 823 |
| M M | 0 M | → | 0 M | |
| M M | 0 0 | → | 0 0 | |
| M 0 | M M | → | M M | |
| M 0 | M 0 | → | M 0 | |
| M 0 | 0 M | → | 0 M | |
| M 0 | 0 0 | → | 0 0 | |
| 0 M | M M | → | M M | |
| 0 M | M 0 | → | M 0 | |
| 0 M | 0 M | → | 0 M | |
| 0 M | 0 0 | → | 0 0 | |

RN2 REPLACEMENT — NO RN4 REPLACEMENT, OR A PORTION REPLACED WITH 0 OR S

| LN | RN2 | → | REPLACEMENT | |
|---|---|---|---|---|
| M M | M M | → | L M | ~ 821 |
| M M | M 0 | → | L M | 822 |
| M M | 0 M | → | L M | |
| M M | 0 0 | → | M M | |
| M 0 | M M | → | L M | |
| M 0 | M 0 | → | L 0 | |
| M 0 | 0 M | → | M M | |
| M 0 | 0 0 | → | M 0 | |
| 0 M | M M | → | L M | |
| 0 M | M 0 | → | M M | |
| 0 M | 0 M | → | L 0 | |
| 0 M | 0 0 | → | 0 M | |

(WHEN A 2 DOT RULED LINE, MAKE DOTS OF ADJACENT PIXEL PX2 LARGER)

(FORM SUPPLEMENTATION DOTS IN A2 WITH MORE DOTS)

Fig. 11

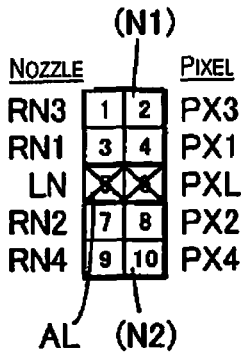

(4 ≤ Nsum ≤ 6)

0: NO DOTS
M: MEDIUM DOTS FORMED
L: LARGE DOTS FORMED

TBL4 (MEDIUM INK VOLUME)

RN1 REPLACEMENT (N1≥N2) RN3 REPLACEMENT

| LN | RN1 | → | REPLACEMENT | | RN3 | → | REPLACEMENT | |
|---|---|---|---|---|---|---|---|---|
| M M | M M | → | L M | ··· | M 0 | → | 0 0 | ~ 831 |
| M M | M 0 | → | L M | ··· | M 0 | → | 0 0 | ~ 832 |
| M M | 0 M | → | L M | ··· | M 0 | → | 0 0 | ~ 832 |
| M M | 0 0 | → | M M | ··· | NO RN3 REPLACEMENT | | | ~ 835 |
| M 0 | M M | → | L M | ··· | M 0 | → | 0 0 | ~ 832 |
| M 0 | M 0 | → | L 0 | ··· | M 0 | → | 0 0 | ~ 832 |
| M 0 | 0 M | → | M M | ··· | M 0 | → | 0 0 | ~ 837 |
| M 0 | 0 0 | → | M 0 | ··· | NO RN3 REPLACEMENT | | | ~ 835 |
| 0 M | M M | → | L M | ··· | M 0 | → | 0 0 | ~ 832 |
| 0 M | M 0 | → | M M | ··· | M 0 | → | 0 0 | ~ 837 |
| 0 M | 0 M | → | L 0 | ··· | M 0 | → | 0 0 | ~ 832 |
| 0 M | 0 0 | → | 0 M | ··· | NO RN3 REPLACEMENT | | | ~ 835 |

WHEN L AFTER RN1 REPLACEMENT AND RN3 = (M, 0), CULL OR MAKE SMALLER THE DOTS OF THE SECONDARY ADJACENT PIXEL PX3

TBL5 (MEDIUM INK VOLUME)

RN2 REPLACEMENT (N1<N2) RN4 REPLACEMENT

| LN | RN2 | → | REPLACEMENT | | RN4 | → | REPLACEMENT | |
|---|---|---|---|---|---|---|---|---|
| M M | M M | → | L M | ··· | M 0 | → | 0 0 | ~ 833 |
| M M | M 0 | → | L M | ··· | M 0 | → | 0 0 | ~ 834 |
| M M | 0 M | → | L M | ··· | M 0 | → | 0 0 | ~ 834 |
| M M | 0 0 | → | M M | ··· | NO RN4 REPLACEMENT | | | ~ 836 |
| M 0 | M M | → | L M | ··· | M 0 | → | 0 0 | ~ 834 |
| M 0 | M 0 | → | L 0 | ··· | M 0 | → | 0 0 | ~ 834 |
| M 0 | 0 M | → | M M | ··· | M 0 | → | 0 0 | ~ 838 |
| M 0 | 0 0 | → | M 0 | ··· | NO RN4REPLACEMENT | | | ~ 836 |
| 0 M | M M | → | L M | ··· | M 0 | → | 0 0 | ~ 834 |
| 0 M | M 0 | → | M M | ··· | M 0 | → | 0 0 | ~ 838 |
| 0 M | 0 M | → | L 0 | ··· | M 0 | → | 0 0 | ~ 834 |
| 0 M | 0 0 | → | 0 M | ··· | NO RN4 REPLACEMENT | | | ~ 836 |

WHEN L AFTER RN2 REPLACEMENT AND RN4 = (M, 0), CULL OR MAKE SMALLER THE DOTS OF THE SECONDARY ADJACENT PIXEL PX4

Fig. 12

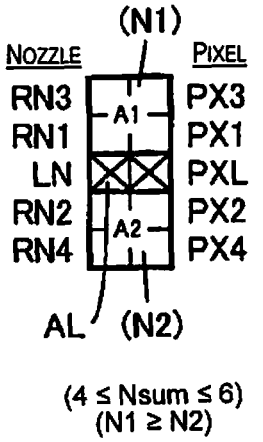

0: NO DOTS
S: SMALL DOTS FORMED
M: MEDIUM DOTS FORMED
L: LARGE DOTS FORMED
*: ALL CASES

TBL4 (MEDIUM INK VOLUME)

RN1 REPLACEMENT

| LN | RN1 | → | REPLACEMENT |
|---|---|---|---|
| M M | M M | → | M M |
| M M | M 0 | → | L M |
| M M | 0 M | → | L M |
| M M | 0 0 | → | M M |
| M 0 | M M | → | L M |
| M 0 | M 0 | → | L 0 |
| M 0 | 0 M | → | M M |
| M 0 | 0 0 | → | M 0 |
| 0 M | M M | → | L M |
| 0 M | M 0 | → | M M |
| 0 M | 0 M | → | L 0 |
| 0 M | 0 0 | → | 0 M |

RN3 REPLACEMENT

| RN3 | → | REPLACEMENT |
|---|---|---|
| * * | → | M M |

~ 841

NO RN3 REPLACEMENT, OR A PORTION REPLACED WITH 0 OR S

RN2 REPLACEMENT

| LN | RN2 | → | REPLACEMENT |
|---|---|---|---|
| M M | M M | → | M M |
| M M | M 0 | → | M 0 |
| M M | 0 M | → | 0 M |
| M M | 0 0 | → | 0 0 |
| M 0 | M M | → | M M |
| M 0 | M 0 | → | M 0 |
| M 0 | 0 M | → | 0 M |
| M 0 | 0 0 | → | 0 0 |
| 0 M | M M | → | M M |
| 0 M | M 0 | → | M 0 |
| 0 M | 0 M | → | 0 M |
| 0 M | 0 0 | → | 0 0 |

RN4 REPLACEMENT

| RN4 | → | REPLACEMENT |
|---|---|---|
| * * | → | M M |

~ 842

NO RN4 REPLACEMENT

WHEN A 2 OR 3 DOT RULED LINE, ARRANGE DOTS ON SECONDARY ADJACENT PIXELS PX3 AND PX4

FORM SUPPLEMENTATION DOTS IN A1 WITH MORE DOTS

Fig. 13

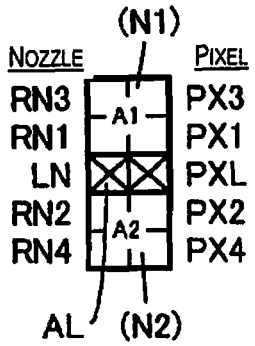

(4 ≤ Nsum ≤ 6)
(N1 < N2)

0: NO DOTS
S: SMALL DOTS FORMED
M: MEDIUM DOTS FORMED
L: LARGE DOTS FORMED
*: ALL CASES

TBL5 (MEDIUM INK VOLUME)

RN1 REPLACEMENT

| LN | RN1 | → | REPLACEMENT |
|---|---|---|---|
| X X | X X | → | X X |
| M M | M 0 | → | M 0 |
| M M | 0 M | → | 0 M |
| M M | 0 0 | → | 0 0 |
| M 0 | M M | → | M M |
| M 0 | M 0 | → | M 0 |
| M 0 | 0 M | → | 0 M |
| M 0 | 0 0 | → | 0 0 |
| 0 M | M M | → | M M |
| 0 M | M 0 | → | M 0 |
| 0 M | 0 M | → | 0 M |
| 0 M | 0 0 | → | 0 0 |

RN3 REPLACEMENT

~ NOT POSSIBLE

NO RN3 REPLACEMENT

RN2 REPLACEMENT

| LN | RN2 | → | REPLACEMENT |
|---|---|---|---|
| M M | M M | → | M M |
| M M | M 0 | → | L M |
| M M | 0 M | → | L M |
| M M | 0 0 | → | M M |
| M 0 | M M | → | L M |
| M 0 | M 0 | → | L 0 |
| M 0 | 0 M | → | M M |
| M 0 | 0 0 | → | M 0 |
| 0 M | M M | → | L M |
| 0 M | M 0 | → | M M |
| 0 M | 0 M | → | L 0 |
| 0 M | 0 0 | → | 0 M |

RN4 REPLACEMENT

| RN4 | → | REPLACEMENT |
|---|---|---|
| * * | → | M M |

~ 851

NO RN4 REPLACEMENT, OR A PORTION REPLACED WITH 0 OR S (WHEN A 2 DOT RULED LINE, ARRANGE DOTS ON SECONDARY ADJACENT PIXEL PX4)

(FORM SUPPLEMENTATION DOTS IN A2 WITH MORE DOTS)

Fig. 14

IMAGE FORMING DEVICE AND DOT PATTERN DETERMINING METHOD

CROSS-REFERENCE TO RELATED APPLICATIONS

This application claims priority to Japanese Patent Application No. 2014-025386 filed on Feb. 13, 2014. The entire disclosure of Japanese Patent Application No. 2014-025386 is hereby incorporated herein by reference.

BACKGROUND

1. Technical Field

The present invention relates to an image forming device and a dot pattern determining method.

2. Related Art

With inkjet printers, for example, a plurality of nozzles aligned in a designated nozzle alignment direction and an object to be printed (object to be recorded) are moved relative to each other in a scan direction orthogonal to the nozzle alignment direction, ink droplets (liquid droplets) are discharged from nozzles according to recording data expressing the presence or absence of dots for each pixel, and dots are formed on the object to be printed. When ink droplets are not discharged from the nozzles or the discharged ink droplets do not draw the correct trajectory due to a clog or the like, "missing dot" areas for which pixels for which dots are not formed are formed connected in the scan direction, and streaks called white streaks occur on the print image. With the technology noted in JP-A-2005-74944 (patent document 1), the supplementation locations of dots to be printed by ink discharge-defective nozzles for which the dot formation is defective are determined according to priority sequence given individually to each "missing dot" pixel, and ink droplets are discharged from peripheral nozzles so as to form dots in the determined supplementation locations.

SUMMARY

In images expressed by recording data, there are cases when ruled lines facing the scan direction are included. For example, with medium duty for which the ink duty in relation to the object to be printed (dot formation ratio in relation to the pixels) is higher than about 30% and lower than about 70%, when the ruled line is a two-dot ruled line having a two dot thickness, there are cases when the original recording data becomes data for which a two-dot ruled line is formed with an ink discharge-defective nozzle and an adjacent nozzle that is adjacent to the ink discharge-defective nozzle in the nozzle alignment direction. The technology described above simply determines the location of supplementation dots according to the priority sequence given individually to each "missing dot" pixel, so in the nozzle alignment direction, there are cases when supplementation dots are formed in the first adjacent area of the first and second adjacent areas sandwiching the "missing dot" area, and cases when supplementation dots are formed in the second adjacent area. Specifically, by supplementation dots being formed on both sides of a one-dot ruled line by adjacent nozzles, the ruled line becomes unclear, and the image quality of the print image decreases. The same is also true for cases when various types of multiple dot ruled lines of two dots or more are formed by the original recording data, such as a three-dot ruled line being formed by an ink discharge-defective nozzle and adjacent nozzles at both sides of the ink discharge-defective nozzle in the nozzle alignment direction.

The kind of problem noted above is not limited to inkjet printers, and the same situation also exists for various technologies.

Considering the above, one aspect of the present invention is to provide technology which makes it possible to more suitably supplement dots by defective nozzles for which dot formation is defective.

To achieve one of the aspects noted above, the present invention has a mode as an image forming device in which a plurality of nozzles aligned in a designated alignment direction and an object to be recorded are moved relative to each other in a scan direction different from the alignment direction, wherein a plurality of pixels constituting a formed image includes dot omission pixels continuous in the scan direction by a defective nozzle included in the plurality of nozzles, adjacent pixels that are adjacent to the dot omission pixels in the alignment direction, and secondary adjacent pixels that are adjacent to the adjacent pixels at positions on a side opposite to the dot omission pixels from the adjacent pixels, the image forming device including a pattern determining unit, when dots are formed continuously in the scan direction on the dot omission pixels within a designated range in the scan direction when according to the recording data before supplementation of dots by the defective nozzle, and dots are formed continuously in the scan direction on the adjacent pixels within the designated range, configured to determine a dot pattern after supplementation formed on the plurality of pixels based on the recording data so as to perform at least one of (A) enlarging at least a portion of the dots formed on the adjacent pixels within the designated range, and (B) arranging dots in the secondary adjacent pixels within the designated range, and a pattern forming unit configured to form the dot pattern after supplementation.

Also, the present invention has a mode as a dot pattern determining method for an image forming device in which a plurality of nozzles aligned in a designated alignment direction and an object to be recorded are moved relative to each other in a scan direction different from the alignment direction, the dot pattern determining method including determining, when dots are formed continuously in the scan direction on the dot omission pixels within a designated range in the scan direction when according to the recording data before supplementation of dots by the defective nozzle, and dots are formed continuously in the scan direction on the adjacent pixels within the designated range, a dot pattern after supplementation formed on the plurality of pixels based on the recording data so that at least one of (A) noted above and (B) noted above is performed.

When dots are formed continuously in the scan direction on dot omission pixels within the designated range in the scan direction when according to the recording data before supplementation of dots by the defective nozzle, and dots are formed continuously in the scan direction on adjacent pixels within the designated range, there is a possibility of a two-dot or greater ruled line. In this case, at least one of enlarging at least a portion of the dots formed on the adjacent pixels within the designated range, and arranging dots in the secondary adjacent pixels within the designated range is performed. When dots formed on the adjacent pixels within the designated range are enlarged, the part to be formed by the defective nozzle of the multiple dot ruled line is supplemented at the adjacent pixels of the ruled line part. When dots are arranged in the secondary adjacent pixels within the designated range, the part to be formed by the defective nozzle of the multiple dot ruled line is supplemented at the secondary adjacent pixels adjacent to the ruled line part. Therefore, with this mode, it is possible to provide technology that can more suitably supplement multiple dot ruled lines by nozzles including a defective nozzle for which dot formation is defective.

Furthermore, the present invention has a mode as an image forming device in which a plurality of nozzles aligned in a designated alignment direction and an object to be recorded are moved relative to each other in a scan direction different from the alignment direction, wherein a plurality of pixels constituting a formed image includes dot omission pixels continuous in the scan direction by a defective nozzle included in the plurality of nozzles, and neighboring pixels that are within a designated distance in the alignment direction from the dot omission pixels, and a designated range including a portion of the dot omission pixels and a portion of the neighboring pixels includes a first area and a second area sandwiching the dot omission pixels in the alignment direction, when the total number of the dot omission pixels and the neighboring pixels within the designated range is Nmax, the image forming device including a pattern determining unit, when the number Nsum of dots to be formed on the pixels within the designated range when according to the recording data before supplementation of dots by the defective nozzle is a first designated number T1 or greater (T1>0) and a second designated number T2 or less (T1<T2<Nmax), configured to determine a dot pattern after supplementation to be formed on the plurality of pixels based on the recording data so as to arrange the dots to be supplemented in the pixels of an area for which, of the first area and the second area, the number N1 of dots to be formed in the pixels of the first area when according to the recording data, or the number N2 of dots to be formed in the pixels of the second area when according to the recording data is larger, and a pattern forming unit configured to form the dot pattern after supplementation.

Furthermore, the present invention includes a mode as a dot pattern determining method for an image forming device in which a plurality of nozzles aligned in a designated alignment direction and an object to be recorded are moved relative to each other in a scan direction different from the alignment direction, the dot pattern determining method including determining, when the number Nsum of dots to be formed on the pixels within the designated range when according to the recording data before supplementation of dots by the defective nozzle is a first designated number T1 or greater (T1>0) and a second designated number T2 or less (T1<T2<Nmax), a dot pattern after supplementation to be formed on the plurality of pixels based on the recording data so as to arrange the dots to be supplemented in the pixels of an area for which, of the first area and the second area, the number N1 of dots to be formed in the pixels of the first area when according to the recording data, or the number N2 of dots to be formed in the pixels of the second area when according to the recording data is larger.

When the number Nsum of dots to be formed on pixels within the designated range when according to the recording data before supplementation of dots by the defective nozzle is T1≤Nsum≤T2, when dots are concentrated in the area with a greater dot count in the vicinity of the dot omission area, a dot pattern after supplementation is formed that has a good appearance. Therefore, with this mode, it is possible to provide technology for which more suitable supplementation is possible of dots by the defective nozzle for which dot formation is defective.

Furthermore, the present invention can also be used for a device such as a printing device including an image forming device, an image forming method such as a printing method including a dot pattern determining method, an image forming program that realizes on a computer functions corresponding to each part described above, a program such as a printing program including this image forming program, a medium that can be read by a computer on which these programs are recorded, and the like. The above-mentioned device can be separately configured by a plurality of component.

BRIEF DESCRIPTION OF THE DRAWINGS

Referring now to the attached drawings which form a part of this original disclosure:

FIG. 10 is a drawing schematically showing an example of the structure of the medium ink volume pattern table TBL4;

FIG. 11 is a drawing schematically showing an example of the structure of the medium ink volume pattern table TBL5;

FIG. 12 is a drawing schematically showing another example of the structure of medium ink volume pattern tables TBL4 and TBL5;

FIG. 13 is a drawing schematically showing another example of the structure of the medium ink volume pattern table TBL4;

FIG. 14 is a drawing schematically showing another example of the structure of the medium ink volume pattern table TBL5;

DETAILED DESCRIPTION OF EMBODIMENTS

Figure 1:
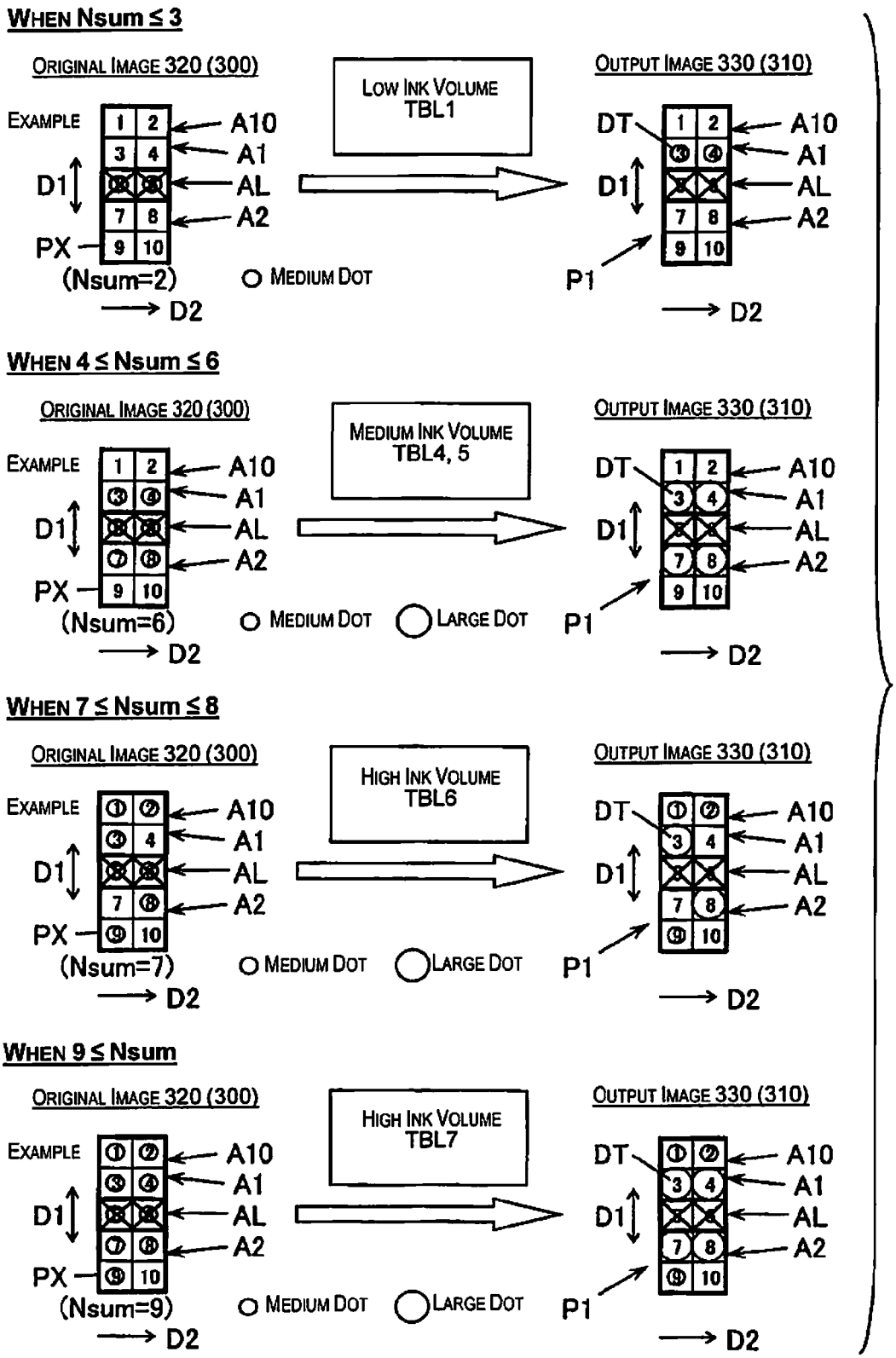
FIG. 1 is a drawing schematically showing an example of determining a dot pattern P1 after supplementation based on a number Nsum of dots to be formed in pixels PX within a designated range A10.

Following, we will describe embodiments of the present invention. Of course, the embodiments below are nothing more than examples of the present invention, and all of the characteristics shown in the embodiments are not necessarily essential as means of solving of the invention.

(1) SUMMARY OF THE TECHNOLOGY

First, we will describe a summary of this technology while referring to FIGS. 1 through 19.

A plurality of nozzles 64 of this technology are aligned in a designated alignment direction D1. When a plurality of nozzle rows 68 are provided, the plurality of nozzles 64 means the plurality of nozzles 64 aligned in the alignment direction D1 contained in each nozzle row 68. This kind of plurality of nozzles 64 and an object to be recorded 400 are moved relative to each other in a scan direction D2 which is different from the alignment direction D1. The nozzles 64 and the object to be recorded 400 moving relative to each other includes the nozzles 64 not moving while the object to be recorded 400 is moved in the scan direction D2 as with a line printer, the object to be recorded 400 not moving while the nozzles 64 move in the scan direction D2, and both the nozzles 64 and the object to be recorded 400 moving in the scan direction D2. A plurality of pixels PX constituting a formed image 330 includes dot omission pixels PXL continuous in the scan direction D2 by defective nozzles LN included in the plurality of nozzles 64, adjacent pixels adjacent to the dot omission pixels PXL in the alignment direction D1 (means at least one of PX1 and PX2, same hereafter), and secondary adjacent pixels adjacent to the adjacent pixels at positions on the side opposite to the dot omission pixels PXL from the adjacent pixel (means at least one of PX3 and PX4, same hereafter). The pattern determining unit U1 of this image forming device 1, when dots DT are formed continuously in the scan direction D2 on the dot omission pixels PXL within the designated range A10 in the scan direction D2 when according to the recording data 300 before supplementation of dots DT by the defective nozzle LN, and dots DT are formed continuously in the scan direction D2 on the adjacent pixels PX1 and PX2 within the designated range A10, determines the pattern P1 of the dots DT after supplementation formed on the plurality of pixels PX based on the recording data 300 such that at least one of (A) enlarging at least a portion of the dots DT formed on the adjacent pixels PX1 and PX2 within the designated range A10, and (B) arranging the dots DT on the secondary adjacent pixels PX3 and PX4 within the designated range A10 is performed. The pattern forming unit U2 of this image forming device 1 forms the pattern P1 of the dots DT after supplementation.

When at least a portion of the dots DT formed on the adjacent pixels PX1 and PX2 within the designated range A10 is enlarged, the part to be formed by the defective nozzle LN of the multiple dot ruled line is supplemented at the adjacent pixels of the ruled line part. When dots DT are arranged on the secondary adjacent pixels PX3 and PX4 within the designated range, the part to be formed by the defective nozzle LN of the multiple dot ruled line is supplemented by secondary adjacent pixels adjacent to the ruled line. Therefore, the multiple dot ruled line by the nozzles 64 including the defective nozzle LN for which dot DT formation is defective is more suitably supplemented.

Here, in addition to forming the dot pattern P1 on the object to be recorded 400, forming the dot pattern P1 includes forming the dot pattern P1 on other than the object to be recorded 400 such as displaying the dot pattern P1.

The plurality of pixels can also include neighboring pixels PXR that are within a designated distance L1 in the alignment direction D1 from the dot omission pixels PXL. When the total number of the dot omission pixels PXL and the neighboring pixels PXR within the designated range A10 is Nmax, the pattern determining unit U1, when the number Nsum of dots DT to be formed on the dot omission pixels PXL and the neighboring pixels PXR within the designated range A10 in the scan direction D2 when according to the recording data 300 is a first designated number T1 or greater (T1>0) and a second designated number T2 or less (T1<T2<Nmax), the dots DT are formed continuously in the scan direction D2 in the dot omission pixels PXL within the designated range A10 in the scan direction D2 when according to the recording data 300, and the dots DT are formed continuously in the scan direction D2 in the adjacent pixels PX1 and PX2 within the designated range A10, determines the pattern P1 of dots DT after supplementation so that at least one of (A) noted above and (B) noted above is performed.

When the dot DT forming ratio on the pixels PX is small at Nsum<T1, there is a low possibility of a multiple dot ruled line being formed by the nozzles 64 including the defective nozzle LN. Also, when the dot DT forming ratio on the pixels PX is large at Nsum>T2, an almost flat filled in image is formed, and there is a low possibility of a multiple dot ruled line being formed. In light of that, for the process of determining the pattern P1 of the dots DT after supplementation so as to perform at least one of (A) noted above and (B) noted above, the process is decreased by performing when T1≤Nsum≤T2. Therefore, with this mode, it is possible to accelerate the process of supplementing the dots DT by the defective nozzle LN.

Nsum being greater than (T1−1) is included in Nsum being T1 or greater. Nsum being less than (T2+1) is included in Nsum being T2 or less. The same is true hereafter.

The designated range A10 that includes the dot omission pixels PXL and the neighboring pixels PXR can also include a first area A1 and a second area A2 sandwiching the dot omission pixels PXL (dot omission area AL) in the alignment direction D1. The pattern determining unit U1 determines the pattern P1 of dots DT after supplementation such that at least one of enlarging at least a portion of the dots DT formed in the adjacent pixels PX1 and PX2 in the subject area which is the area for which, of the first area A1 and the second area A2, the number N1 of dots DT to be formed in the pixels PX of the first area A1 when according to the recording data 300 or the number N2 of dots DT to be formed in the pixels PX of the second area A2 when according to the recording data 300 is larger, and arranging dots DT in the secondary adjacent pixels PX3 and PX4 of the subject area, is performed.

There is a high possibility that the multiple dot ruled line extending across the dot omission pixels PXL and the adjacent pixel (PX1 or PX2) will be formed in the area with the greater number of dots in the vicinity of the dot omission area AL. Because of this, when at least a portion of the dots DT formed on the adjacent pixels of the subject area with a larger amount of dots in the vicinity of the dot omission area AL are enlarged, or dots DT are arranged at the secondary adjacent pixel of the subject area (PX3 or PX4), the multiple dot ruled line by the nozzles 64 including the defective nozzle LN is more suitably supplemented.

The pattern determining unit U1 has a first pattern determining unit U11 that determines the pattern P1 of dots DT after supplementation so as to enlarge at least a portion of the dots DT formed on the adjacent pixels PX1 and PX2 within the designated range A10, a second pattern determining unit U12 that determines the pattern P1 of dots DT after supplementation so that dots DT are arranged in the secondary adjacent pixels PX3 and PX4 within the designated range A10, and a switching unit U13 that switches whether the pattern P1 of dots DT after supplementation is to be determined by the first pattern determining unit U11 or determined by the second pattern determining unit U12. With this mode, when the multiple dot ruled line is supplemented by the nozzles 64 including the defective nozzle LN, it is possible to switch whether to enlarge at least a portion of the dots DT forming the adjacent pixels PX1 and PX2 within the designated range A10 or to arrange dots DT in the secondary adjacent pixels PX3 and PX4 within the designated range A10 according to the properties of the object to be recorded 400 or the like, for example. Therefore, it is possible to more suitably supplement the multiple dot ruled line by the nozzles 64 including the defective nozzle LN.

This technology also has a mode as an image forming device 1 for which a plurality of nozzles 64 and an object to be recorded 400 are moved relative to each other, wherein in the plurality of pixels PX, included are dot omission pixels PXL and adjacent pixels PX1 and PX2, equipped with a pattern determining unit U1 that, when dots DT are formed continuously in the scan direction D2 on the dot omission pixels PXL within a designated range A10 in the scan direction D2 when according to the recording data 300 before supplementation of dots DT by the defective nozzle LN, and dots DT are formed continuously in the scan direction D2 on the adjacent pixels PX1 and PX2 within the designated range A10, determines the pattern P1 of dots DT after supplementation formed on the plurality of pixels PX based on the recording data 300 so as to enlarge at least a portion of the dots DT formed on the adjacent pixels PX1 and PX2 within the designated range A10, and a pattern forming unit U2 for forming the pattern P1 of dots DT after supplementation. When at least a portion of the dots DT formed on the adjacent pixels PX1 and PX2 within the designated range A10 is enlarged, the part of the multiple dot ruled line to be formed by the defective nozzle LN is supplemented. Therefore, the multiple dot ruled line by the nozzles 64 including the defective nozzle LN for which dot DT formation is defective is more suitably supplemented.

This technology also has a mode as an image forming device 1 for which a plurality of nozzles 64 and an object to be recorded 400 are moved relative to each other, wherein in the plurality of pixels 64, included are dot omission pixels PXL, adjacent pixels PX1 and PX2, and secondary adjacent pixels PX3 and PX4, equipped with a pattern determining unit U1 that, when dots DT are formed continuously in the scan direction D2 on the dot omission pixels PXL within a designated range A10 in the scan direction D2 when according to the recording data 300 before supplementation of dots DT by the defective nozzle LN, and dots DT are formed continuously in the scan direction D2 on the adjacent pixels PX1 and PX2 within the designated range A10, determines the pattern P1 of dots DT after supplementation formed on the plurality of pixels PX based on the recording data 300 so as to arrange the dots DT in the secondary adjacent pixels PX3 and PX4 within the designated range A10, and a pattern forming unit U2 for forming the pattern P1 of dots DT after supplementation. When dots DT are arranged on the secondary adjacent pixels PX3 and PX4 within the designated range A10, the part of the multiple dot ruled line to be formed by the defective nozzle LN is supplemented. Therefore, the multiple dot ruled line by the nozzles 64 including the defective nozzle LN for which dot DT formation is defective is more suitably supplemented.

Furthermore, this technology can also have a mode as an image forming device 1 for which a plurality of nozzles 64 and an object to be recorded 400 are moved relative to each other, wherein in the plurality of pixels PX, included are dot omission pixels PXL and neighboring pixels PXR, in the designated range A10 including a portion of the dot omission pixels PXL and a portion of the neighboring pixels PXR are included a first area A1 and a second area A2 sandwiching the dot omission pixels PXL in the alignment direction D1, and when the total number of the dot omission pixels PXL and the neighboring pixels PXR within the designated range A10 is Nmax, is equipped with a pattern determining unit U1 that, when the number Nsum of dots DT to be formed on the pixels PX within the designated range A10 when according to the recording data 300 before supplementation of dots DT by the defective nozzle LN is a first designated number T1 or greater ($T1>0$) and a second designated number T2 or less ($T1<T2<Nmax$), determines the pattern P1 of dots DT after supplementation to be formed on the plurality of pixels PX based on the recording data 300 so as to arrange the dots DT to be supplemented in the pixels PX of the area for which, of the first area A1 and the second area A2, the number N1 of dots DT to be formed in the pixels PX of the first area A1 when according to the recording data 300, or the number N2 of dots DT to be formed in the pixels PX of the second area A2 when according to the recording data 300 is larger, and a pattern forming unit U2 for forming the pattern P1 of dots DT after supplementation.

In the image expressed by the recording data 300, there are parts with low dot density and parts with high dot density. With the technology noted in Unexamined Patent Publication No. 2005-74944, the supplementation dot locations are determined simply according to priority sequence, so there are cases when the dot supplementation feels like it is unsuitable, such as when viewing the print image, compared to the image expressed by the original recording data 300, it feels more concentrated or feels thinner or the like. In contrast to this, with the mode noted above, when $T1 \leq Nsum \leq T2$, by dots DT being concentrated in the area for which there is a higher number of dots in the vicinity of the dot omission area AL, the pattern P1 of the dots DT after supplementation with a good visual appearance is formed. Therefore, with the mode noted above, it is possible to provide technology for which it is possible to more suitably supplement dots DT by the defective nozzle LN.

When according to the recording data 300, when $T1 \leq Nsum \leq T2$, and there are pixels for which the dots DT are not formed in the dot omission pixels PXL within the designated range A10, the pattern determining unit U1 can also determine the pattern P1 of the dots DT after supplementation formed on the plurality of pixels PX based on the recording data 300 so as to arrange the dots DT to be supplemented in the pixels PX of the area for which N1 and N2 is larger between the first area A1 and the second area A2. With this mode, when a multiple dot ruled line is not formed in the area including the dot omission area AL, it is possible to more suitably supplement the dots DT by the defective nozzle LN.

(2) CONSTITUTION OF THE IMAGE FORMING DEVICE

Figure 2:
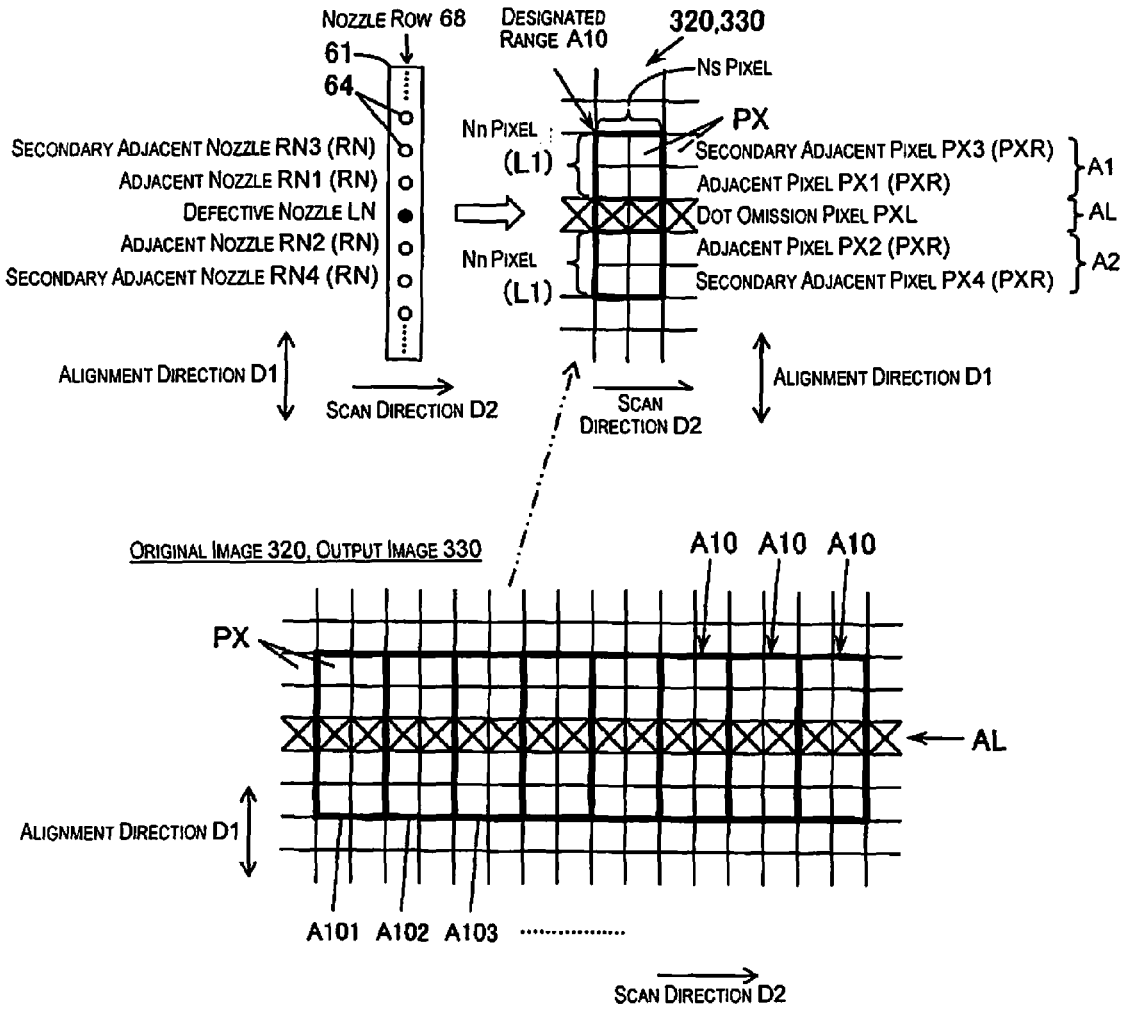
FIG. 2 is a drawing schematically showing an example of the correlation between nozzles 64 and pixels PX.
Figure 3:
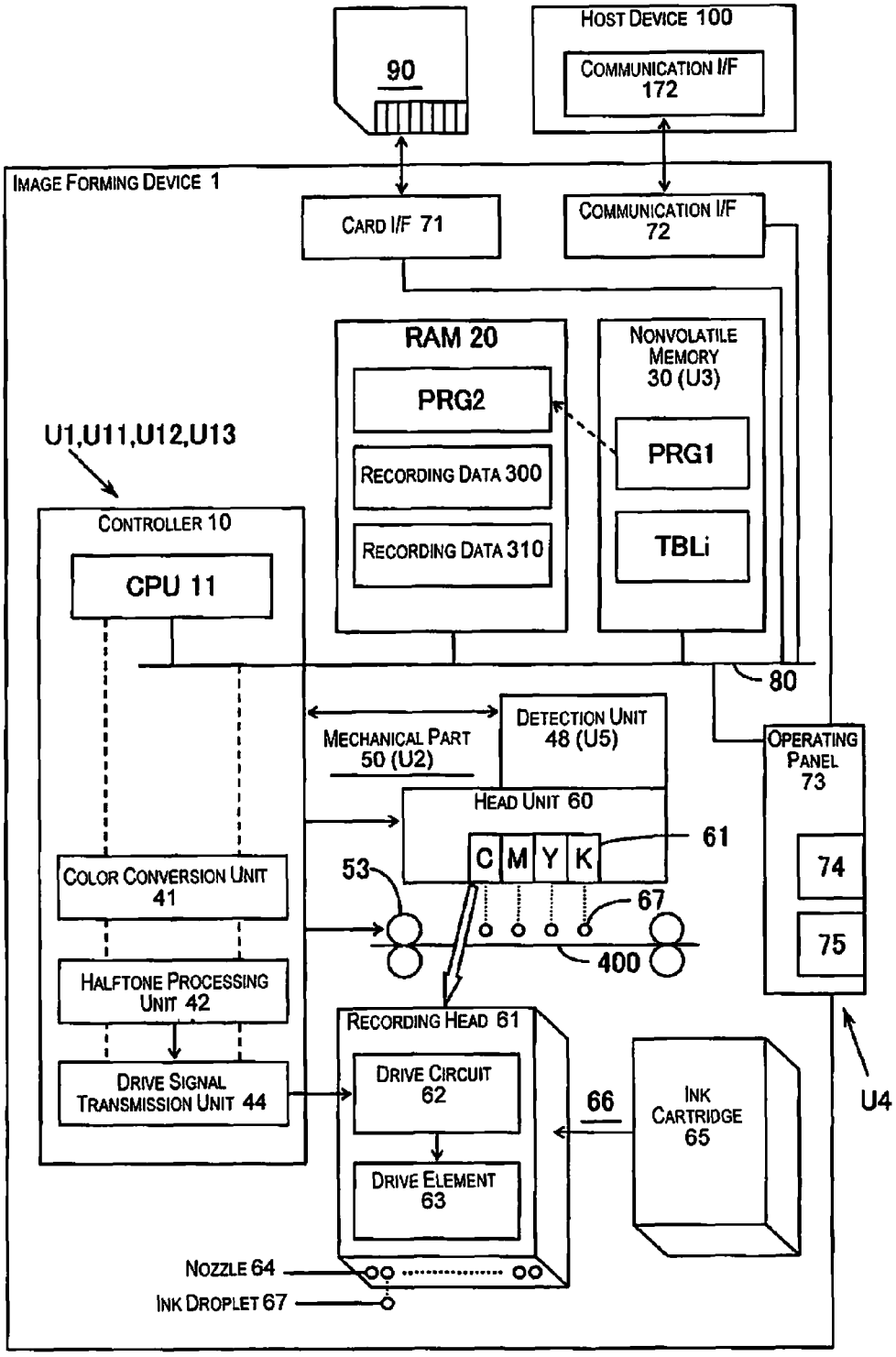
FIG. 3 is a drawing schematically showing a constitutional example of the image forming device 1.
Figure 4:
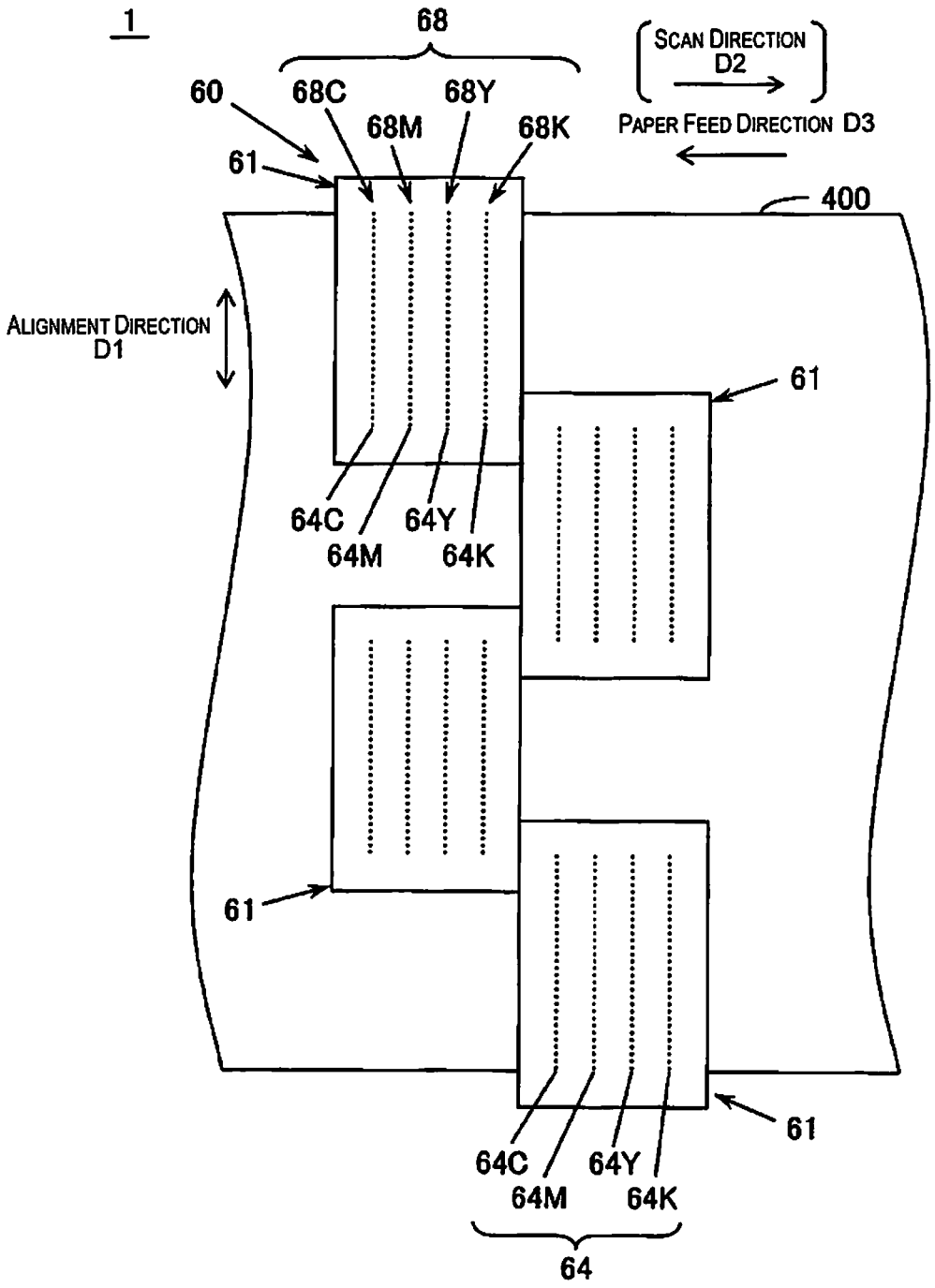
FIG. 4 is a drawing schematically showing an example of the key parts of a line printer as the image forming device 1.

FIG. 1 is a drawing schematically showing an example of determining a pattern P1 of dots DT after supplementation based on a number Nsum of dots DT to be formed in pixels PX within a designated range A10. FIG. 2 is a drawing schematically showing an example of the correlation between nozzles 64 and pixels PX. FIG. 3 is a drawing schematically showing a constitutional example of the image forming device 1. FIG. 4 is a drawing schematically showing an example of the key parts of a line printer as the image forming device 1. In these drawings, code number D1 indicates the alignment direction of the nozzles 64, code number D2 indicates the scan direction D2 of the recording head 61, and code number D3 indicates the paper feed direction opposite to the scan direction D2. The alignment direction D1 and the scan direction D2 (paper feed direction D3) are acceptable as long as they cross each other, and not only being orthogonal but also not being orthogonal is included in the present invention. Being orthogonal in the present invention includes not exactly being orthogonal with errors. To show this in an easy to understand manner, the enlargement ratio of each direction may differ, and the drawings may not match with each other.

The image forming device 1 generates recording data 310 expressing the output image 330 for which there has been supplementation of dots to be formed by the defective nozzles LN based on the recording data 300 expressing the original image 320 before dot supplementation. The images 320 and 330 before and after supplementation are multi-value or binary images expressing the presence or absence (status) of the formation of dots DT for the respective pixels PX aligned systematically with the respective alignment direction D1 and the scan direction D2. The output image 330 is an image actually formed on the object to be recorded 400, for example. The original image 320 is a virtual image that is not actually formed, because it is the image before dots are supplemented.

First, we will describe an example of the correlation of the nozzles 64 and the pixels PX. A head unit 60 shown in FIG. 4 is equipped with recording heads 61 having a C (cyan) nozzle row 68C, an M (magenta) nozzle row 68M, a Y (yellow) nozzle row 68Y, and a K (black) nozzle row 68K. The recording heads 61 can also be provided separately by colors CMYK. The nozzle rows 68C, 68M, 68Y, and 68K are aligned in the paper feed direction D3 of the object to be recorded 400 such as printing paper (one type of object to be printed). The head unit 60 is fixed so as not to move, so the scan direction D2 of the recording head 61 becomes a direction opposite to the paper feed direction D3. Each nozzle row 68C, 68M, 68Y, and 68K has nozzles 64C, 64M, 64Y, and 64K aligned in the alignment direction D1. This technology includes cases for which even with nozzle rows for which the nozzles are arranged in zigzag form, the plurality of nozzles are aligned for example in two rows in a designated alignment direction different from the scan direction. The alignment direction in this case means the direction in which the nozzles are aligned for each row with the zigzag arrangement.

The head unit 60 shown in FIG. 4 has a plurality of recording heads 61 arranged to be able to form dots DT on the object to be recorded 400 using ink droplets (liquid droplets) 67 discharged (sprayed) from the nozzles 64C, 64M, 64Y, and 64K across the entire width direction of the object to be recorded 400 (alignment direction D1). Here, the nozzle rows 68C, 68M, 68Y, and 68K are collectively named nozzle row 68, and the nozzles 64C, 64M, 64Y, and 64K are collectively named nozzles 64.

There are cases when defective nozzles LN occur in the nozzle row 68 when ink droplets are not discharged or discharged ink droplets do not draw the correct trajectory due to clogging or the like. When there is a defective nozzle LN for which dot DT formation is defective, as shown in FIG. 2, a "missing dot" area (dot omission area AL) for which dot omission pixels PXL for which dots DT are not formed are connected in the scan direction D2 is formed on the object to be recorded 400. Specifically, the plurality of pixels PX constituting the formed image 330 includes the dot omission pixels PXL continuous in the scan direction D2 by the defective nozzles LN included in the plurality of nozzles 64. A colored streak of the object to be recorded 400 occurs on the output image 330 due to the dot omission area AL. If the object to be recorded 400 is white, a white streak occurs. This technology has dots DT by the defective nozzles LN supplemented so as to make it difficult for this kind of streak to stand out.

For convenience of the description, the nozzles at both sides adjacent to the defective nozzle LN in the alignment direction D1 (primary neighboring nozzles) are called adjacent nozzles RN1 and RN2, and the pixels of both sides adjacent to the dot omission pixels PXL in the alignment direction D1 (primary neighboring pixels) are called adjacent pixels PX1 and PX2. With the example in FIG. 2, dots DT are formed on the adjacent pixels PX1 and PX2 by ink droplets 67 discharged from the adjacent nozzles RN1 and RN2. Also, the nozzles that are nozzles within a designated distance L1 from the defective nozzle LN in the alignment direction D1 and nozzles on the side opposite to the defective nozzle LN from the adjacent nozzles RN1 and RN2 (secondary neighboring nozzles) are called non-adjacent nozzles (secondary adjacent nozzles RN3 and RN4), and the pixels that are within the designated distance L1 from the dot omission pixels PXL in the alignment direction D1 and are pixels on the side opposite to the dot omission pixels PXL from the adjacent pixels PX1 and PX2 (secondary neighboring pixels) are called non-adjacent pixels (secondary adjacent pixels PX3 and PX4). The secondary adjacent nozzle RN3 is a nozzle adjacent to the adjacent nozzle RN1 at the position on the side opposite to the defective nozzle LN from the adjacent nozzle RN1. The secondary adjacent nozzle RN4 is a nozzle adjacent to the adjacent nozzle RN2 at a position on the side opposite to the defective nozzle LN from the adjacent nozzle RN2. The secondary adjacent pixel PX3 is a pixel adjacent to the adjacent pixel PX1 at the position on the side opposite to the dot omission pixels PXL from the adjacent pixel PX1. The secondary adjacent pixel PX4 is a pixel adjacent to the adjacent pixel PX2 at the position of the side opposite to the dot omission pixels PXL from the adjacent pixel PX2. With the example in FIG. 2, the dots DT are formed on the secondary adjacent pixels PX3 and PX4 by ink droplets 67 discharged from the secondary adjacent nozzles RN3 and RN4.

The adjacent pixels PX1 and PX2 and the secondary adjacent pixels PX3 and PX4 are pixels within the designated distance L1 in the alignment direction D1 from the dot omission pixels PXL. These pixels PX1, PX2, PX3, and PX4 are collectively called neighboring pixels PXR, and the neighboring nozzles RN1, RN2, RN3, and RN4 are collectively called neighboring nozzles RN. The designated range A10 which is the processing unit for dot supplementation has a total of 10 pixels of Ns=2 pixels continuous in the scan direction D2 respectively for the dot omission pixels PXL and the neighboring pixels (PX1, PX2, PX3, and PX4). Specifically, the size of the designated range A10 in the scan direction D2 is Ns=2 pixels. Of the designated range A10, there is a first area A1 of a total of 4 pixels of neighboring pixels (PX1 and PX3) at one side of the alignment direction D1 from the dot omission area AL, and a second area A2 of a total of 4 pixels of the neighboring pixels (PX2 and PX4) at the other side. Specifically, the size of both areas A1 and A2 in the alignment direction D1 is respectively Nn=2 pixels.

As shown in FIG. 1, the numbers 1 through 10 are given to each pixel of the 2×5 pixel designated range A10, in order to identify each pixel of the designated range A10.

The image forming device 1 is equipped with a pattern determining unit U1 and a pattern forming unit U2 as the basic elements. The pattern determining unit U1 determines the pattern P1 of the dots DT after supplementation formed on the neighboring pixels PXR within the designated range A10 based on at least the number Nsum of dots DT to be formed on the pixels PX within the designated range A10 including a portion of the dot omission pixels PXL and a portion of the neighboring pixels PXR when according to the recording data 300 before supplementation of the dots DT by the defective nozzles LN. The pattern forming unit U2 forms the pattern P1 of the dots DT after supplementation.

To perform the process described above, as shown in FIG. 1, pattern tables TBLi in which are stored information expressing the pattern P1 of the dots DT after supplementation are prepared, and the pattern P1 of the dots DT after supplementation can be determined according to the information stored in the pattern tables TBLi. Here, i is information for identifying the pattern table. The pattern tables TBLi store information corresponding to the number Nsum of the dots DT to be formed on the dot omission pixels PXL and the neighboring pixels PXR within the designated range when according to the recording data 300 before dot supplementation.

With the example in FIG. 1, when the dot count Nsum of the 2×5=10 pixels of the original image 320 when according to the recording data 300 before supplementation is 3 or less, the dot pattern P1 after supplementation is determined according to the low ink volume pattern table TBL1, and the output image 330 is formed according to the recording data 310 after supplementation. With the example in FIG. 1, shown is the arrangement of the medium dots to be formed on the number 5 and 6 dot omission pixels as supplementation dots on the number 3 and 4 pixels of the first area A1. When the dot number Nsum is the first designated number T1=4 or greater and the second designated number T2=6 or less ($0<T1<T2<Nmax=10$), the dot pattern P1 after supplementation is determined according to either of the medium ink volume pattern tables TBL4 and TBL5. With the example in FIG. 1, shown is the arrangement of supplementation dots on the number 3 and 4 pixels of the first area A1, and on the number 7 and 8 pixels of the second area A2, for which medium dots to be formed on the number 5 and 6 dot omission pixels are changed to large dots. When $7 \leq Nsum \leq 8$, the dot pattern P1 after supplementation is determined according to the high ink volume pattern table TBL6. With the example in FIG. 1, shown is the arrangement of supplementation dots in the number 3 and 8 pixels for which the medium to dots be formed on the number 5 and 6 dot omission pixels are changed to large dots. When $Nsum \geq 9$, the dot pattern P1 after supplementation is determined according to the high ink volume pattern table TBL7. With the example in FIG. 1, shown is the arrangement of supplementation dots on the number 3 and 4 pixels of the first area A1 and on the number 7 and 8 pixels of the second area A2 for which medium dots to be formed on the number 5 and 6 dot omission pixels are changed to large dots. These processes are performed in sequence with the designated range A10 unit for the band area up to Nn=2 pixels centering on the dot omission pixels PXL continuous in the scan direction D2 of the original image 320 as shown in FIG. 2.

The image forming device 1 shown in FIG. 3 is equipped with a RAM (Random Access Memory) 20, a nonvolatile memory 30 (pattern storage unit U3), a defective nozzle detection unit 48, a mechanical part 50, interfaces (I/F) 71 and 72, an operating panel 73 and the like. The controller 10, the RAM 20, the nonvolatile memory 30, the I/F 71 and 72, and the operating panel 73 are connected to a bus 80, and are able to input and output information with each other. The image forming device 1 shown in FIG. 2 is an inkjet printer that discharges ink droplets 67, but it is also possible to apply this technology to an image forming device other than an inkjet printer.

The controller 10 is equipped with a CPU (Central Processing Unit) 11, a color conversion unit 41, a halftone processing unit 42, a drive signal transmission unit 44 and the like. The controller 10 constitutes the pattern determining unit U1, together with the mechanical part 50 constitutes the pattern forming unit U2, together with the operating panel 73 constitutes the setting receiving unit U4, and together with the defective nozzle detection unit 48 constitutes defective nozzle detection unit U5. The controller 10 can be constituted by an SoC (System on a Chip) or the like.

The CPU 11 is a device that centrally performs information processing and control with the image forming device 1. The color conversion unit 41 is an item that converts the input image color space (e.g., RGB (red, green, blue) color space) from a host device 100 memory card 90 or the like to, for example, output coordinate values of the CMYK color space (Cj, Mj, Yj, and Kj) for each pixel. Here, j is information for identifying the pixel. Coordinate values Rj, Gj, Bj, Cj, Mj, Yj, and Kj express the gradation values of multiple gradations with integer values of 256 gradations of 0 to 255, for example. The halftone processing unit 42 performs a designated halftone process such as for example the dither method, the error diffusion method, and the density pattern method on the gradation values of each pixel constituting the image after color conversion to reduce the gradation count of the gradation values, and generates multi-value data. The multi-value data is data expressing the dot formation status, and can be binary data expressing the presence or absence of dot formation, or can be multi-value data of three gradations or greater that can handle dots of different sizes such as large, medium and small dots. With binary data, for example, it is possible to use data for which 1 corresponds to dot formation and 0 corresponds to no dots. As 4-value data, for example, it is possible to use data for which 3 corresponds to large dot formation, 2 corresponds to medium dot formation, 1 corresponds to small dot formation, and 0 corresponds to no dots. The drive signal transmission unit 44 generates drive signals corresponding to the voltage signals applied to a drive element 63 of the recording head 61, and outputs those to a drive circuit 62. For example, if the multi-value data is "large dot formation," drive signals for discharging large dot ink droplets (liquid droplets) 67 are output, if the multi-value data is "medium dot formation," drive signals for discharging medium dot ink droplets 67 are output, and if the multi-value data is "small dot formation," drive signals for discharging small dot ink droplets 67 are output. These units 41, 42, and 44 can be constituted using ASIC (Application Specific Integrated Circuits), and can also directly read data of the processing subject from the RAM 20, or directly write data after processing to the RAM 20.

Furthermore, the controller 10 controls the paper feed mechanism 53 and the like in the mechanical part 50.

The mechanical part 50 controlled by the controller 10 is equipped with a paper feed mechanism 53, a head unit 60, a recording unit 61 and the like, and together with the controller 10 constitutes the pattern forming unit U2. The paper feed mechanism 53 conveys in the paper feed direction D3 the object to be recorded 400 that is continuous in the scan direction D2. Mounted on the head unit 60 are recording heads 61 that discharge ink droplets 67 of a plurality of colors (e.g., CMYK). The recording head 61 is equipped with a drive circuit 62, drive element 63 and the like. The drive circuit 62 applies voltage signals to the drive element 63 according to drive signals input from the controller 10. For the drive element 63, it is possible to use a piezoelectric element that adds pressure to the ink 66 inside the pressure chamber in communication with the nozzles 64, a drive element that generates bubbles within the pressure chamber using heat and discharges ink droplets 67 from the nozzle 64 or the like. The ink (liquid) 66 is supplied to the pressure chamber of the recording head 61 from the ink cartridge (liquid cartridge) 65. The combination of the ink cartridge 65 and the recording head 61 can be provided respectively for CMYK, for example. The ink 66 inside the pressure chamber is discharged as ink droplets 67 facing the object to be recorded 400 from the nozzles 64 by the drive element 63. By the object to be recorded 400 being conveyed in the paper feed direction D3, specifically, by the plurality of nozzles 64 and the object to be recorded 400 being moved relative to each other in the scan direction D2, dots of the ink droplets 67 are formed on the object to be recorded 400 such as printing paper (one type of object to be printed) or the like, and a print image (output image 330) corresponding to the recording data 310 is formed. If the multi-value data is 4-value data, the output image 330 is printed by formation of dots according to the dot size expressed by the multi-value data.

The object to be printed (print substrate) is a material that holds a print image. The shape is typically rectangular, but there are also circles (e.g., CD-ROM, optical disks such as a DVD or the like), triangles, squares, polygons and the like, and at least includes all of the types of paper and paperboard and processed products noted in the Japanese Industrial Standards "JIS P0001: 1998, Paper, Paperboard and Pulp Terminology."

The RAM 20 is large capacity, volatile semiconductor memory, and stores a program PRG2, recording data 300 and 310 and the like. The program PRG2 includes an image forming program for realizing on the image forming device a pattern determining function corresponding to each unit U1, U2, U4, and U5 of the image forming device 1, a pattern forming function, a setting receiving function, and a defective nozzle detection function. The image forming program includes a pattern determining program for realizing on a computer a pattern determining function.

In the nonvolatile memory 30 are stored program data PRG1, pattern tables TBLi and the like. The nonvolatile memory 30 constitutes the pattern storage unit U3. For the nonvolatile memory 30, it is possible to use ROM (Read Only Memory), a magnetic recording medium such as a hard disk, or the like. Expanding the program data PRG1 means writing it to the RAM 20 as a program that can be interpreted by the CPU 11.

The card I/F 71 is a circuit that writes data to the memory card 90 and reads data from the memory card 90. The memory card 90 is nonvolatile semiconductor memory for which data can be read and erased, and in which are stored images taken using an imaging device such as a digital camera or the like. The images are expressed using RGB color space pixel values Rj, Gj, and Bj, for example, and each RGB pixel value is expressed using 8-bit gradation values of 0 to 255, for example.

The communication I/F 72 inputs and outputs information to the host device 100 that is connected to the communication I/F 172 of the host device 100. For the communication I/F 72 and 172, it is possible to use a USB (Universal Serial Bus) or the like. The host device 100 includes computers such as a personal computer, digital cameras, digital video cameras, mobile phones such as smart phones, and the like.

The operating panel 73 has an output unit 74, an input unit 75 and the like, and the user can input various instructions to the image forming device 1. The output unit 74, for example, is constituted by a liquid crystal panel (display unit) that displays information according to the various instructions or information showing the status of the image forming device 1. The output unit 74 can also output these kinds of information using voice. The input unit 75, for example, is constituted by operating keys (operating input unit) such as a cursor key or setting key. The input unit 75 can also be a touch panel for receiving operations on the display screen or the like. The operating panel 73, together with the controller 10, constitutes the setting receiving unit U4 that receives the printing mode from among a plurality of printing modes (settings). The information expressing the input printing mode is stored in the RAM 20, for example.

The defective nozzle detection unit 48 detects whether or not the status of each nozzle 64 constituting the nozzle row 68 is normal. The detection unit 48, together with the controller 10, constitutes the defective nozzle detection unit U5.

Figure 5A:
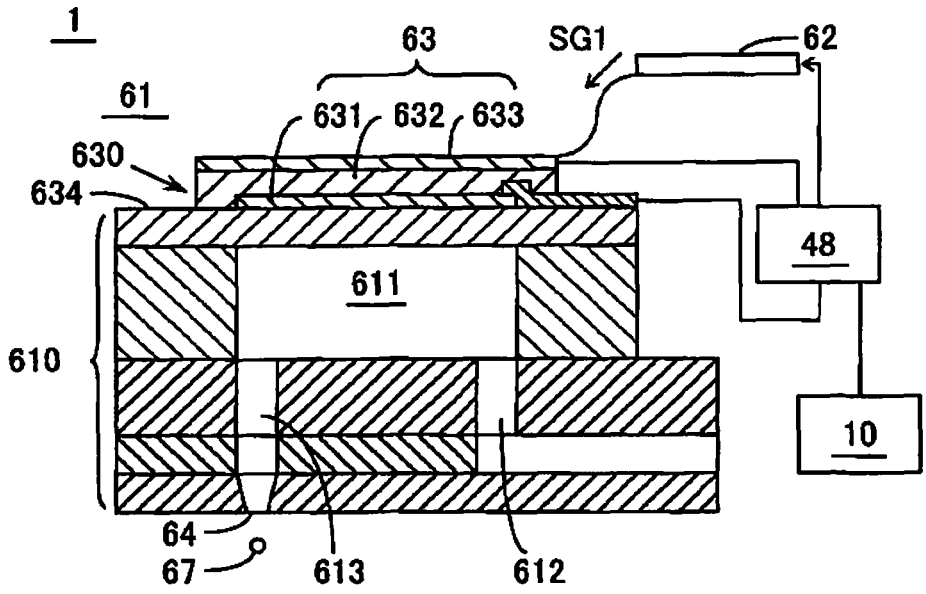
FIG. 5A is a drawing schematically showing an example of the key parts of the image forming device 1.
Figure 5B:
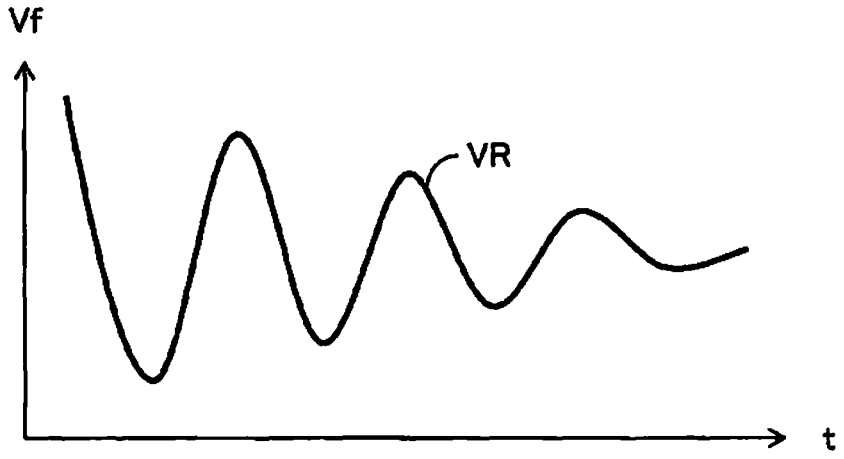
FIG. 5B is a drawing schematically showing an example of the electromotive force curve VR based on the residual vibration of a vibrating plate 630.
Figure 6A:
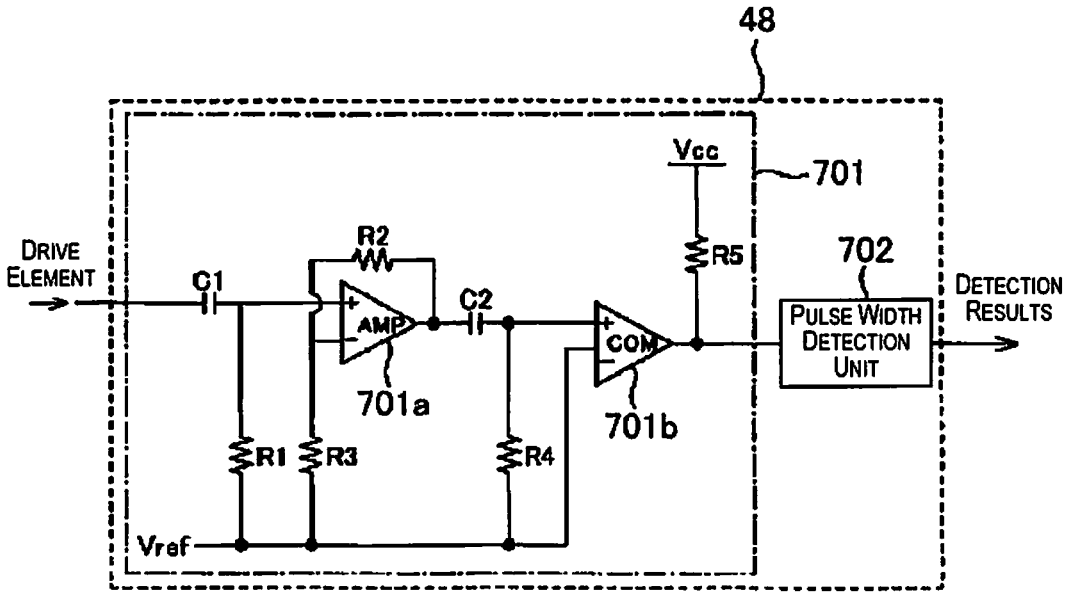
FIG. 6A is a drawing showing an example of the electrical circuits of a defective nozzle detection unit 48.
Figure 6B:
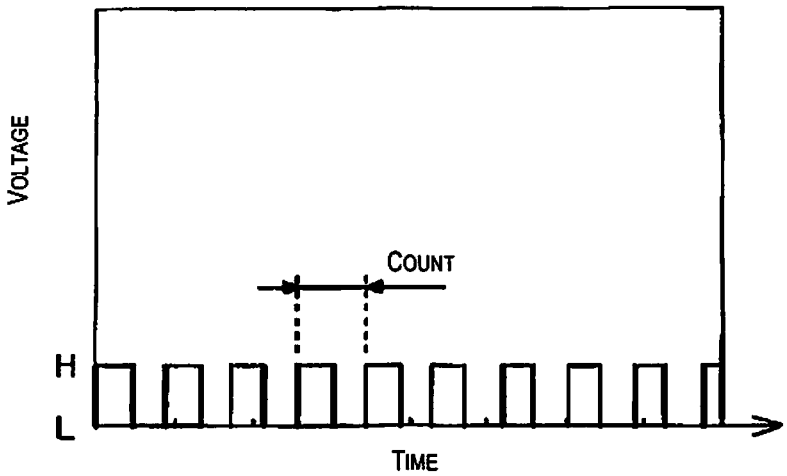
FIG. 6B is a drawing schematically showing an example of the output signals from the amplifier 701.

FIGS. 5A and 5B are drawings for describing examples of methods for detecting the status of the nozzles 64, where FIG. 5A schematically shows an example of the key parts of the image forming device 1, and FIG. 5B schematically shows an example of the electromotive force curve VR based on the residual vibration of a vibrating plate 630. FIG. 6A shows an example of the electrical circuits of a defective nozzle detection unit 48, and FIG. 6B schematically shows an example of the output signals from a comparator 701*b*.

On a flow path substrate 610 of the recording head 61 shown in FIG. 5A, formed are a pressure chamber 611, an ink supply path 612 in which ink 66 flows to the pressure chamber 611 from the ink cartridge 65, a nozzle communication path 613 in which ink 66 flows from the pressure chamber 611 to the nozzle 64 and the like. For the flow path substrate 610, for example, it is possible to use a silicon substrate or the like. The surface of the flow path substrate 610 is used as a vibrating plate part 634 constituting a portion of the wall surface of the pressure chamber 611. The vibrating plate part 634 can be constituted using silicon oxide or the like, for example. The vibrating plate 630 can be constituted from the vibrating plate part 634, the drive element 63 formed on this vibrating plate part 634 and the like, for example. The drive element 63 can be a piezoelectric element having, for example, a lower electrode 631 formed on the vibrating plate part 634, a piezoelectric layer 632 roughly formed on the lower electrode 631, and an upper electrode 633 roughly formed on the piezoelectric layer 632 or the like. For the electrodes 631 and 633, platinum, gold or the like can be used. For the piezoelectric layer 632, for example, it is possible to use a ferroelectric perovskite type oxide such as PZT (lead zirconate titanate), stoichiometric ratio Pb ($Zr_x$, $Ti_{1-x}$)$O_3$) or the like.

FIG. 5A is a block diagram showing the key parts of the image forming device 1 for which a detection unit 48 is provided that detects the status of the electromotive force from the piezoelectric element (drive element 63) based on residual vibration of the vibrating plate 630. One end of the detection unit 48 is electrically connected to the lower electrode 631, and the other end of the detection unit 48 is electrically connected to the upper electrode 633.

FIG. 5B shows an example of the electromotive force curve (electromotive force status) VR of the drive element 63 based on the residual vibration of the vibrating plate 63 that occurs after the supply of drive signals SG1 for discharging ink droplets 67 from the nozzles 64. Here, the horizontal axis is time t, and the vertical axis is electromotive force Vf. The electromotive force curve VR shows an example of ink droplets 67 discharged from a normal nozzle 64. When due to a clog or the like, the ink droplets 67 are not discharged from the nozzle or the discharged ink droplets 67 do not draw the correct trajectory, the electromotive force curve skews from VR. In light of that, it is possible to detect whether the nozzle 64 is normal or defective using a detection circuit like that shown in FIG. 6A.

The detection unit 48 shown in FIG. 6A is equipped with an amplifier 701 and a pulse width detection unit 702. The amplifier 701 is equipped with, for example, an operating amp 701*a*, a comparator 701*b*, capacitors C1 and C2, and resistors R1 through R5. When the drive signals SG1 output from the drive circuit 62 are applied to the drive element 63, residual vibration occurs, and electromotive force based on the residual vibration is input to the amplifier 701. The flow frequency component included in this electromotive force is eliminated by a high pass filter constituted by the capacitor C1 and the resistor R1, and the electromotive force after removal of the low frequency component is amplified at a designated amplification rate by the operating amp 701*a*. The output of the operating amp 701*a* passes through the high pass filter constituted by the capacitor C2 and the resistor R4, is compared with reference voltage Vref by the comparator 701*b*, and depending on whether or not it is higher than the reference voltage Vref, is converted to a high level H or low level L pulse state voltage.

FIG. 6B shows an example of pulse form voltage output from the comparator 701*b* and input to the pulse width detection unit 702. The pulse width detection unit 702 resets the count value when the input pulse form voltage rises, increments the count value every designated period, and outputs that as the detection results of the count value at the rise time of the next pulse form voltage to the controller 10. The count value corresponds to the cycle of the electromotive force based on the residual vibration, and the count value output in sequence shows the frequency characteristics of the electromotive force based on the residual vibration. The frequency characteristics (e.g., cycle) of the electromotive force when the nozzle is the defective nozzle LN are different from the frequency characteristics of the electromotive force when the nozzle is normal. In light of that, the controller 10 is able to judge that the nozzle subject to detection is normal if the sequentially input count value is within an allowed range, and is able to judge that the nozzle subject to detection is the defective nozzle LN if the sequentially input count value is outside the allowed range.

By performing the process described above for each nozzle 64, the controller is able to grasp the status of each nozzle 64, and it is possible to store the information expressing the position of the defective nozzle LN in the RAM 20 or the nonvolatile memory 30, for example.

Of course, detection of defective nozzles LN is not limited to the method described above. For example, discharging ink droplets 67 while sequentially switching the subject nozzle from the plurality of nozzles 64 and receiving operating input of information identifying the nozzle (e.g., the nozzle number) for which dots DT were not formed on the object to be recorded 400 are also included in defective nozzle LN detection. Also, if information identifying the defective nozzle LN before shipping from the manufacturing factory is stored for example in the nonvolatile memory 30, it is not necessary to provide the defective nozzle detection unit U5 in the image forming device 1.

(3) DESCRIPTION OF PRINTING PROCESS INCLUDING THE DOT PATTERN DETERMINING PROCESS

Figure 7:
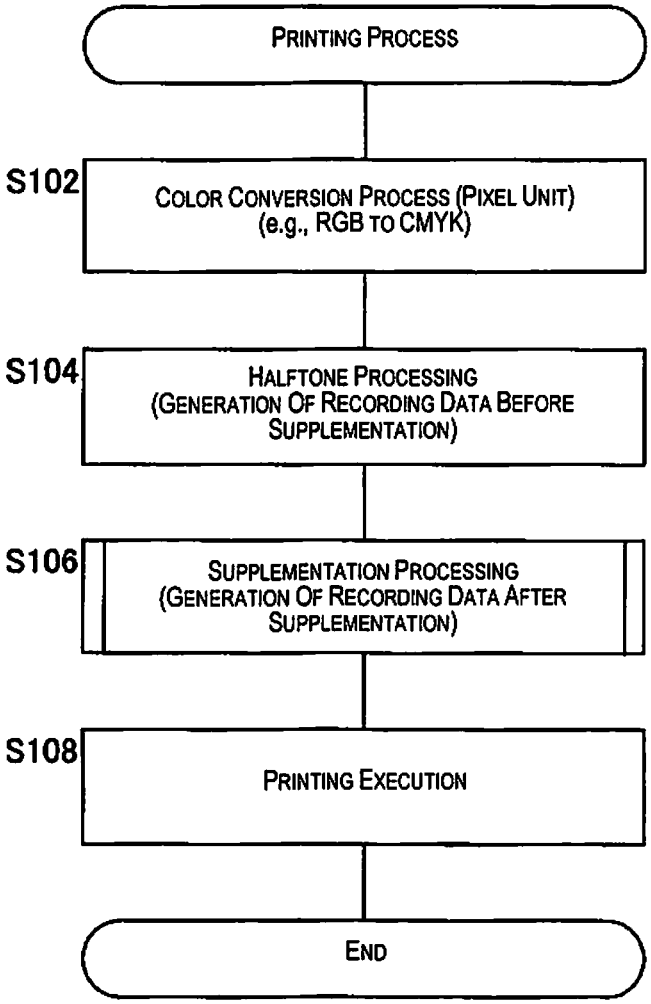
FIG. 7 is a flow chart showing an example of the printing process.
Figure 8:
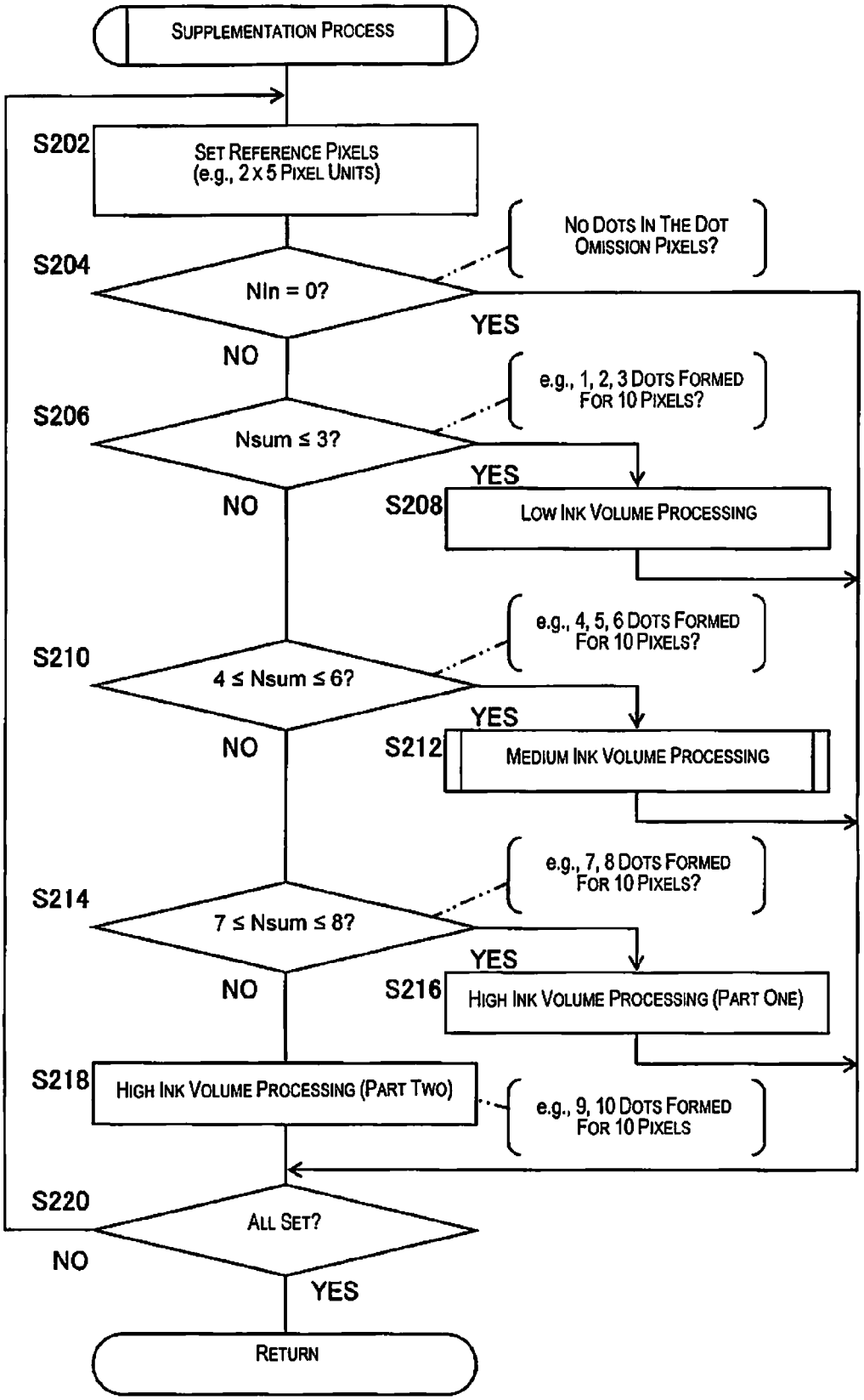
FIG. 8 is a flow chart showing an example of the supplementation process.
Figure 9:
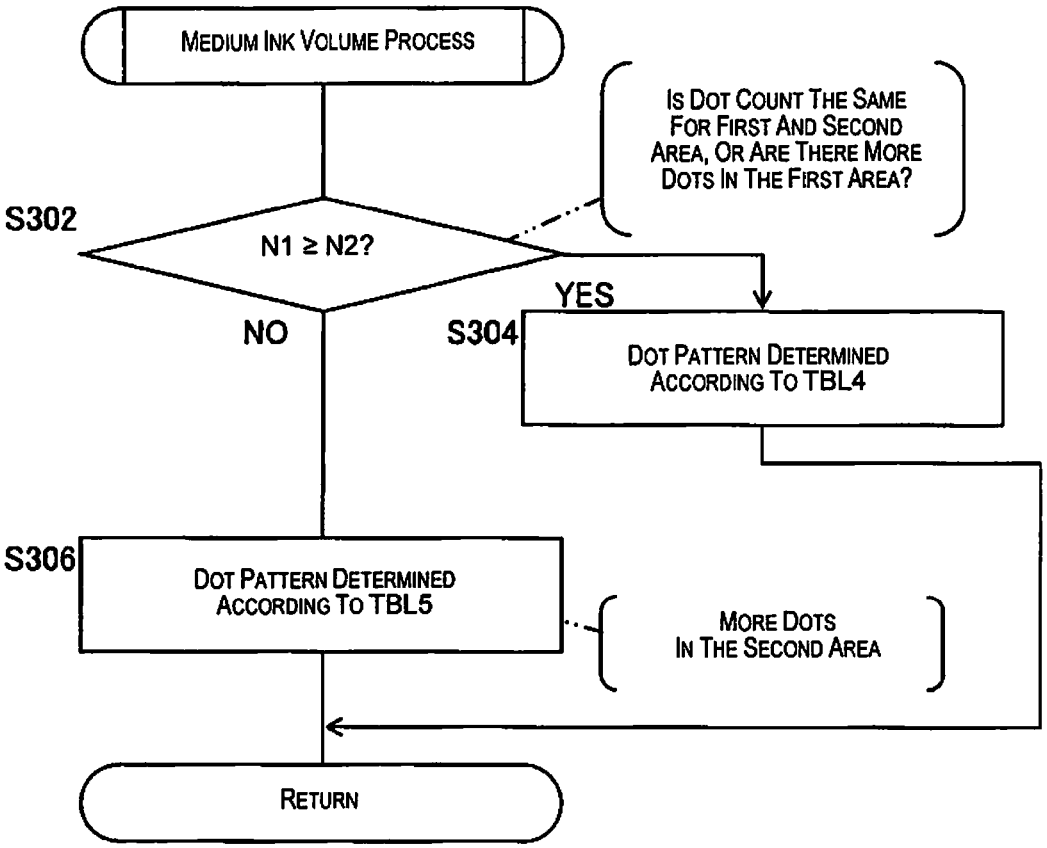
FIG. 9 is a flow chart showing an example of medium ink volume processing.

FIG. 7 is a flow chart showing an example of the printing process performed by the image forming device 1. FIG. 8 is a flow chart showing an example of the supplementation process of step S106 in FIG. 7 according to the dot determining method. FIG. 9 is a flow chart showing an example of the medium ink volume processing of step S212 in FIG. 8. Hereafter, we will omit the notation of "step." Here, S106 corresponds to the pattern determining unit U1, the pattern determining step, and the pattern determining function. S108 corresponds to the pattern forming unit U2, the pattern forming step, and the pattern forming function. The printing process can be realized using electrical circuits or can be realized using a program.

(3-1) Printing Process

For example, when an image and printing instructions are received from the host device 100, the image forming device 1 stores the received image in the RAM 20, and starts the printing process. The images recorded in the memory card 90 undergo the selection operation with the operating panel 73, the image forming device 1 stores the selected image in the RAM 20, and the printing process is started.

When the printing process is started, the controller 10 performs pre-processing such as expanding the program data PRG1 within the nonvolatile memory 30 or converting the input image resolution or the like as necessary, after which it converts the input pixel values (e.g., Rj, Gj, Bj) of the input image space for each pixel to for example output pixel values Cj, Mj, Yj, and Kj of the CMYK color space (S102). At S104, a designated halftone process is performed by the halftone processing unit 42 on the image of the CMYK color space constituted by a concentration of pixel values Cj, Mj, Yj, and Kj of 256 gradations, for example, reducing the gradation count, and multi-value data is generated that expresses the dot forming status for each pixel respectively for CMYK. This multi-value data can be binary data expressing the presence or absence of dot formation, can be 4-value data for which the respective large, medium and small dots can be formed, or it can be multi-value data other than these. The generated multi-value data becomes the recording data 300 before dot supplementation expressing gradations for the original image 320. At S106, supplementation processing is performed on the recording data 300 before dot supplementation, and recording data 310 after dot supplementation is generated. This recording data 310 is multi-value data expressing the dot formation status for each pixel respectively for CMYK, and can be 4-value data for which the respective large, medium, and small dots can be formed, or can be another multi-value data. At S108, the aforementioned drive signals corresponding to the recording data 310 after dot supplementation respectively for large, medium, and small are generated and output to the drive circuit 62 of the recording head 61, the drive element 63 is driven to match the recording data 310 after supplementation, and ink droplets 67 are discharged from the nozzles 64 of the recording head 61 to execute printing. By doing this, a print image (output image 330) of the multi-value (e.g., 4-value) expressing the dot forming status is formed on the object to be recorded 400, and the printing process ends.

(3-2) Supplementation Process

Next, we will describe the supplementation process while referring to FIG. 8 and the like. To make the description easier to understand, the recording data 300 before dot supplementation is data that expresses the presence or absence of medium dot formation, for example data that correlates 2 (or 1) to medium dot formation, and 0 to no dots. Of course, the recording data 300 before supplementation can also be 4-value data or the like that correlates 3 to large dot formation, 2 to medium dot formation, 1 to small dot formation, and 0 to no dots. In this case, it is also possible to perform the supplementation process regarding the large dots and small dots expressed by the recording data 300 as medium dots.

When the supplementation process is started, as shown in FIG. 2, the controller 10 sets 2×5 pixels as reference pixels within the designated range A10 in sequence from the dot omission pixels PXL and the neighboring pixels PXR continuous in the scan direction D2 with the original image 320 expressed by the record data 300 within the RAM 20 (S202). With the example in FIG. 2, Ns=2 pixels of the dot omission pixels PXL continuous in the scan direction D2, and Ns=2 pixels respectively for the neighboring pixels (PX1, PX2, PX3, and PX4) up to Nn=2 pixels from the dot omission pixels PXL in the alignment direction D1 are set as the reference pixels. The setting sequence of the reference pixels is not particularly limited, and it is possible to use the scan direction D2 sequence such as the designated range A101, A102, A103, . . . and the like.

The size Ns of the designated range A10 in the scan direction is preferably 2 pixels or greater since then the degree of freedom for the formed dot pattern is high, and can also be 3 pixels or greater, but when it is 2 pixels, it is possible to do dot supplementation quickly. Also, the size Nn of the designated range A10 in the alignment direction is preferably 2 pixels or greater since then the degree of freedom for the formed dot pattern is high, and can also be 3 pixels or greater, but when it is 2 pixels, it is possible to do dot supplementation quickly.

At S204, a judgment is made of whether or not the count Nln of the dots DT to be formed on the dot omission pixel PXL within the designated range A10 is 0. When Nln=0, the dots to be supplemented are not in the dot omission pixels PXL, so the controller 10 advances the process to S220 without performing the processes of S206 to S218. When Nln does not equal 0, specifically, when the dot count Nln of the dot omission pixel PXL is 1 or 2, the controller 10 branches the process as shown below based on the number Nsum of the dots DT to be formed on the reference pixels within the designated range A10 when according to the recording data 300 before supplementation.

When 1≤Nsum≤3, (S206), low ink volume processing is executed (S208)

When 4≤Nsum≤6, (S210), medium ink volume processing is executed (S212)

When 7≤Nsum≤8, (S214), high ink volume processing (part one) is executed (S216)

When 9≤Nsum≤10, high ink volume processing (part two) is executed (S218)

As shown in FIG. 8, the processes of S206, S210, and S214 are processes for judging whether or not the dot number Nsum fulfills designated conditions. The processes of S208, S212, S216, and S218 are processes for determining the dot pattern P1 after supplementation according to information stored in the pattern tables TBLi (examples shown in FIGS. 10 to 14) corresponding to the dot count Nsum. When according to the recording data 300 before supplementation, all the dots to be formed are medium dots, and the ink duty (ink implantation volume) on the object to be recorded 400 is (Nsum/100)×100%.

From the above, the controller 10 determines the pattern P1 of the dots DT after supplementation based on at least the dot count Nsum in the designated range A10 and the dot count Nln in the dot omission area AL within the designated range A10 when according to the recording data 300 before supplementation. At that time, of the plurality of pattern tables TBLi, the dot pattern P1 after supplementation is determined according to the information stored in the pattern table TBLi corresponding to the dot count Nsum when according to the recording data 300 before supplementation.

After any of the processes of the aforementioned S208, S212, S216, and S218 is performed, the controller 10 judges whether or not the reference pixels have been set for all the dot omission pixels PXL and the neighboring pixels PXR of the original image 320 (S220). When unprocessed pixels remain, the controller 10 repeats the process of S202 to S220. By this process repetition, the dot pattern P1 after supplementation formed on the neighboring pixels PXR within the designated range A10 is determined based on the dot count Nsum of the referenced pixels set in sequence from among the dot omission pixels PXL and the neighboring pixels PXR continuous in the scan direction D2. On the other hand, when all the reference pixels are set, the controller 10 ends the supplementation process. After that, the printing process of S108 in FIG. 7 is performed, and for example a 4-value print image (output image 330) corresponding to the recording data 310 after dot supplementation is formed on the object to be recorded 400.

(3-3) Medium Ink Volume Processing

Figure 15:
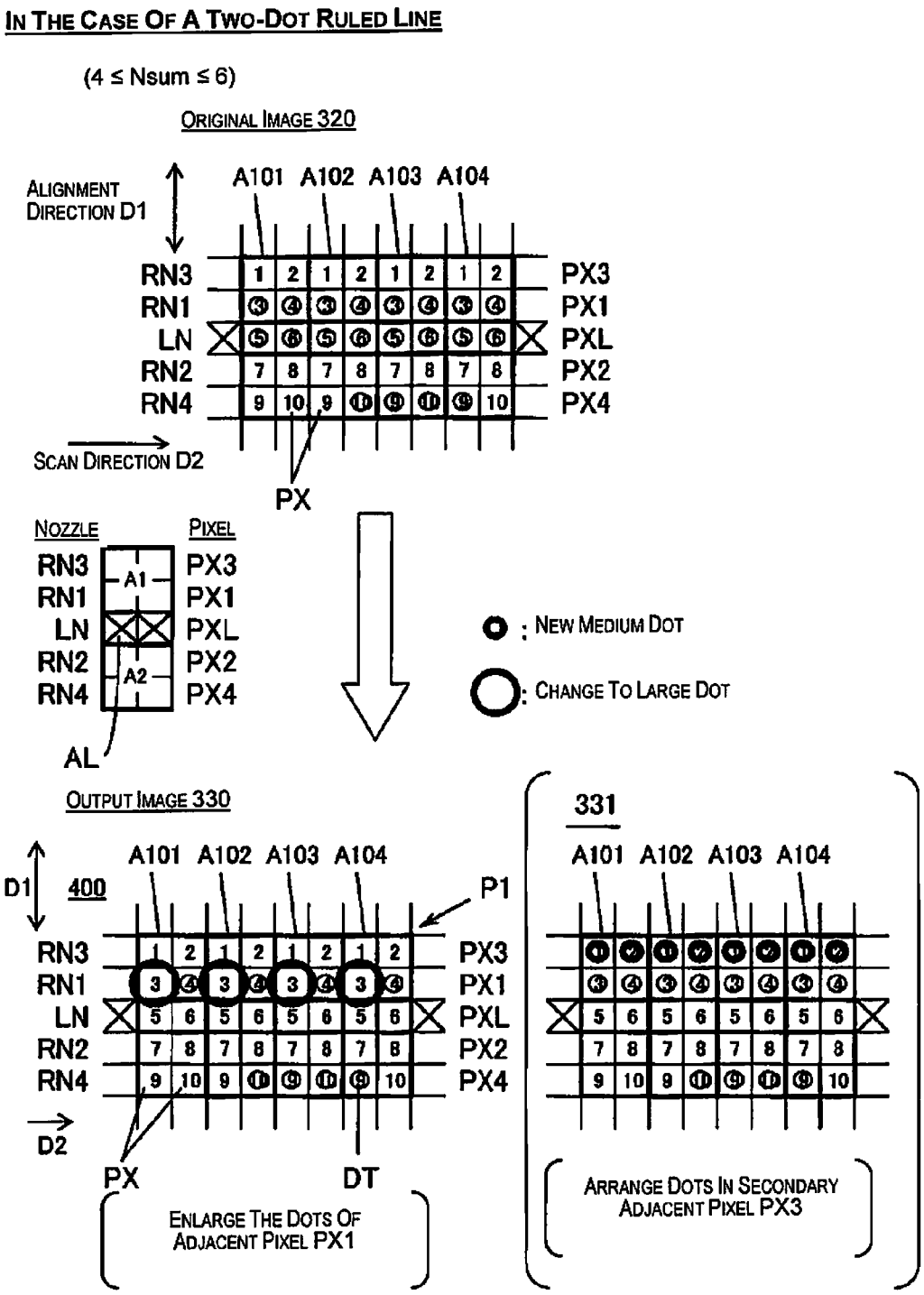
FIG. 15 is a drawing schematically showing an example of the dot pattern P1 formed on a medium ink volume image when a two-dot ruled line is formed on the dot omission pixels PXL and the adjacent pixels.
Figure 16:
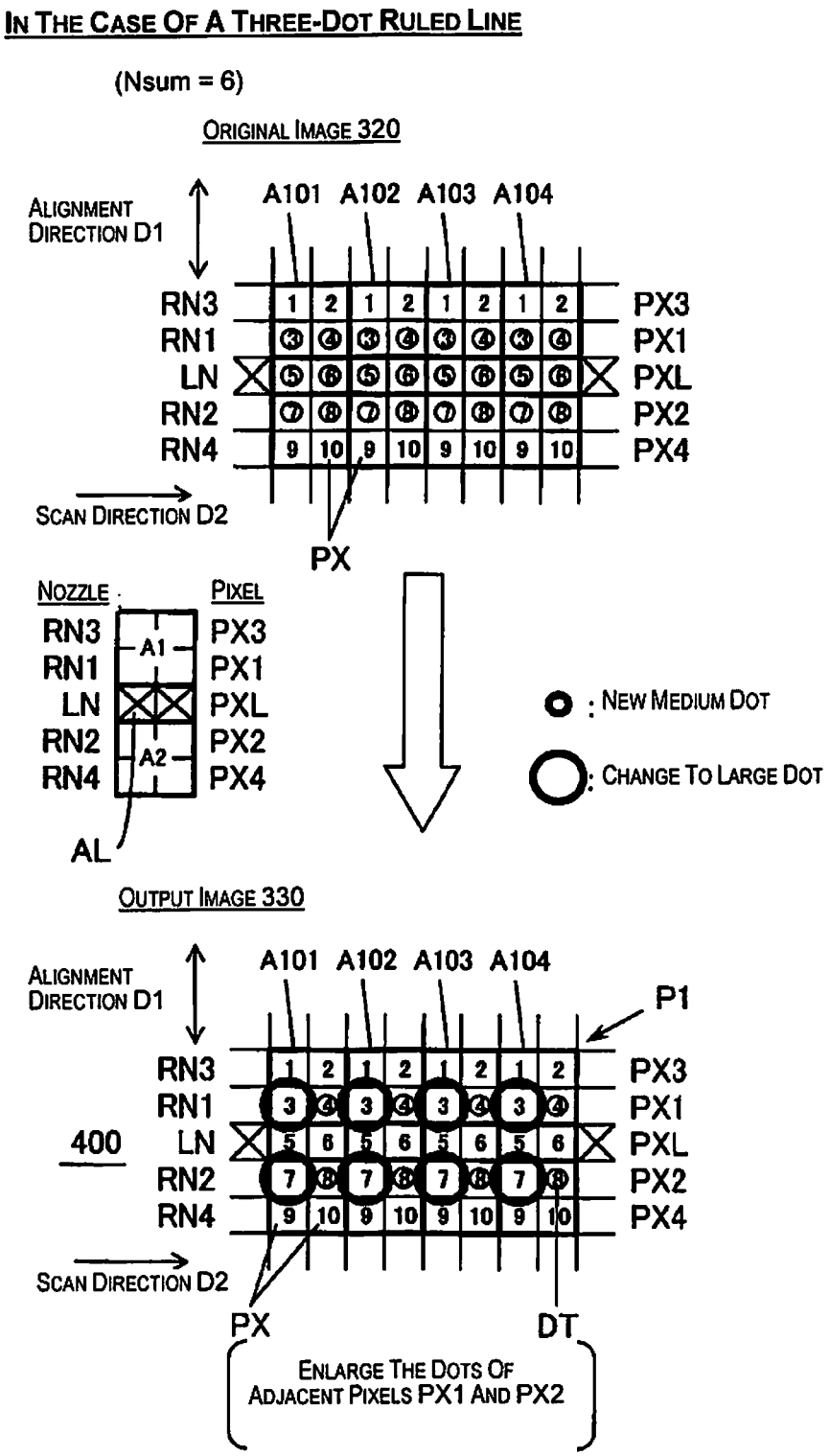
FIG. 16 is a drawing schematically showing an example of the dot pattern P1 formed on a medium ink volume image when a three-dot ruled line is formed on the dot omission pixels PXL and the adjacent pixels on both sides.
Figure 17:
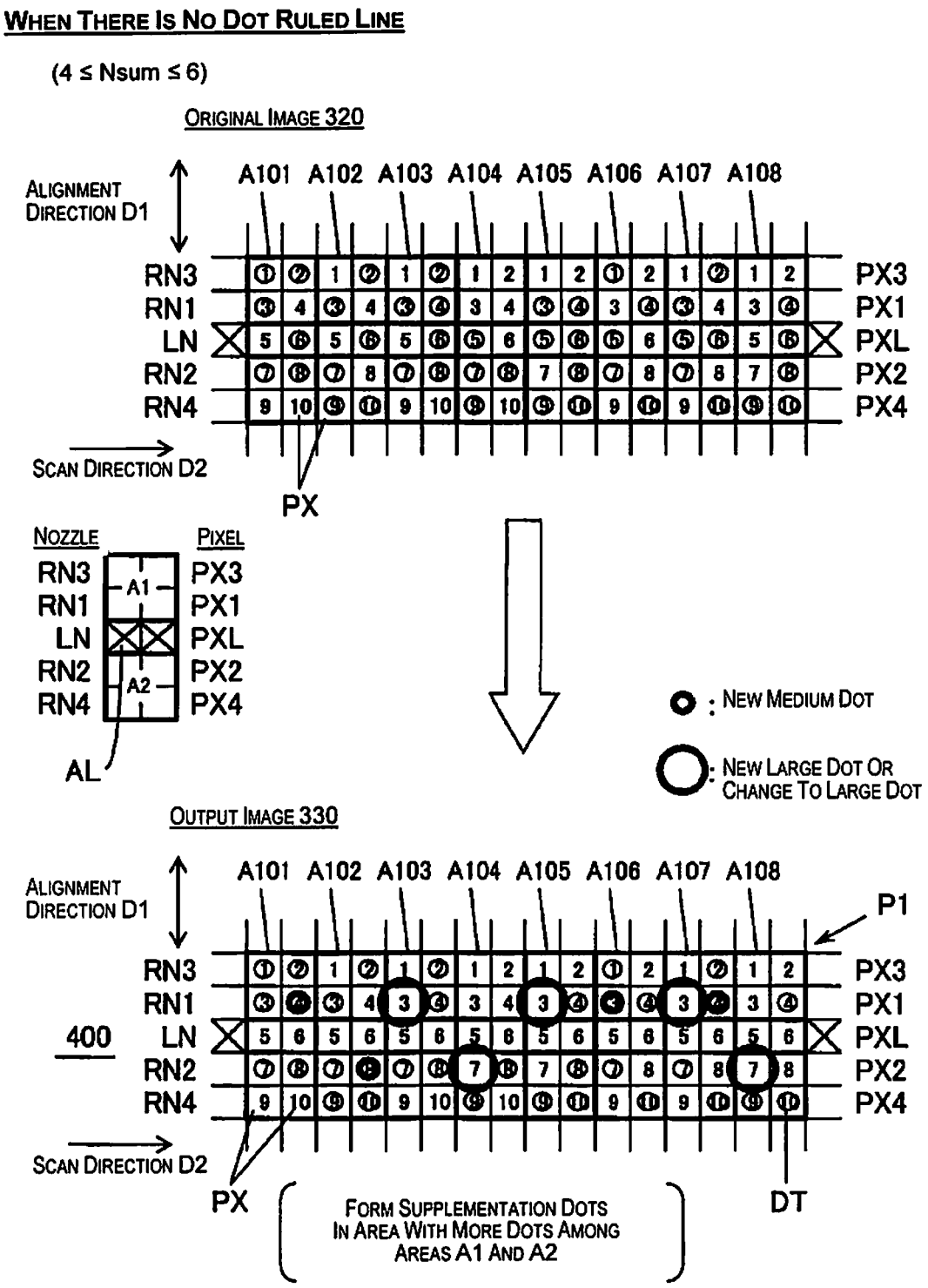
FIG. 17 is a drawing schematically showing an example of the dot pattern P1 formed on a medium ink volume image when a ruled line is not formed on the dot omission pixels PXL.

Next, referring to FIGS. 9 through 17 and the like, we will describe the medium ink volume processing performed when the dot count Nsum in the designated range A10 is the first designated count T1=4 or greater and the second designated count T2=6 or less, specifically, is any of 4, 5, or 6. Here, FIG. 10 schematically shows an example of the structure of the medium ink volume pattern table TBL4 referenced when the dot count N1 for the neighboring pixels (PX1 and PX3) of the first area A1 when according to the recording data 300 before supplementation is the dot count N2 or greater (N1≥N2) for the neighboring pixels (PX2 and PX4) of the second area A2. FIG. 11 schematically shows an example of the structure of medium ink volume pattern table TBL5 referenced when N1<N2 when according to recording data 300 before supplementation. FIG. 12 schematically shows an example of the structure of other medium ink volume pattern tables TBL4 and TBL5 for which dots of the secondary adjacent pixels PX3 and PX4 are culled. FIGS. 13 and 14 schematically show examples of the structure of other medium ink volume pattern tables TBL4 and TBL5 for which supplementation dots are arranged in the secondary adjacent pixels PX3 and PX4 when a multiple dot ruled line is formed in the pixels including the dot omission pixels PXL_FIG. 15 schematically shows an example of the dot pattern P1 formed on the medium ink volume image when a two-dot ruled line is formed on the dot omission pixels PXL and the adjacent pixel PX1 when according to the recording data 300 before supplementation. FIG. 16 schematically shows an example of the dot pattern P1 formed on the medium ink volume image when a three-dot ruled line is formed on the dot omission pixels PXL and adjacent pixels PX1 and PX2 when according to the recording data 300 before supplementation. FIG. 17 schematically shows an example of the dot pattern P1 formed on the medium ink volume image when a ruled line is not formed on the dot omission pixels PXL.

When the medium ink volume processing shown in FIG. 9 is started, the controller 10 branches the process based on the dot count N1 with the first area A1 and the dot count N2 with the second area A2. In specific terms, when N1≥N2 (S302), the dot pattern P1 is determined according to the information stored in the pattern table TBL4 (S304), and medium ink volume processing is ended. When N1<N2, the dot pattern P1 is determined according to the information stored in pattern table TBL5 (S306), and the medium ink volume processing is ended. Working in this way, the controller 10 determines the dot pattern P1 after supplementation based on at least the dot count Nsum for the designated range A10 when according to the recording data 300 before supplementation, the dot count N1 of the first area A1, and the dot count N2 of the second area A2.

First, we will describe the pattern tables TBL4 and TBL5 shown in FIGS. 10 and 11. Here, "RN1 replacement," "RN2 replacement," "RN3 replacement," and "RN4 replacement" respectively show the dot arrangements before and after supplementation according to the dot arrangement of the dot omission pixels PXL and the adjacent pixels for the neighboring pixels (PX1, PX2, PX3, and PX4) corresponding to the neighboring nozzles (RN1, RN2, RN3, and RN4). "0" indicates no dots, "S" indicates small dot formation, "M" indicates medium dot formation, and "L" indicates large dot formation. The ink volume for forming large dots is acceptable as long as it is greater than the ink volume for forming medium dots, and for example, can be approximately twice the ink volume for forming the medium dots. With RN1 and RN2 replacement, the "LN" dot arrangement is the dot arrangement before supplementation of the dot omission pixels PXL, "RN1" is the dot arrangement before supplementation of the adjacent pixel PX1, "RN2" is the dot arrangement before supplementation of the adjacent pixel PX2, and "replacement" is the dot arrangement after replacement of the adjacent pixels PX1 and PX2. For example, with the correlation 811, when "LN" is "MM," and "RN1" is "MM," regardless of the dot arrangement of the pixels PX2, PX3, and PX4, the dot arrangement of the adjacent pixel PX1 after supplementation is "LM." With the correlation 812, when "LN" is "MM," and "RN2" is "MM," regardless of the dot arrangement of the pixels PX1, PX3, and PX4, the dot arrangement of the adjacent pixel PX2 after supplementation is "LM." A dot arrangement that cannot occur in "LN, "RN1," and "RN2" of the pattern tables TBLi shown in FIGS. 10 to 14 is not shown except for when both "LN" and "RN" of pattern table TBL5 shown in FIG. 11 are "MM," but it is also possible to stipulate a correlation of dot arrangements that cannot occur with the pattern table TBLi to prevent erroneous operation.

One characteristic feature of the pattern table TBL4 referenced when N≥N2 is that when "LN" and "RN1" within the designated range A10 in the scan direction D2 are "MM" with dots continuous in the scan direction D2, at least a portion of the "RN1" dots are enlarged. In this case, it is possible that a multiple dot ruled line will be formed extending across the dot omission pixels PXL and the adjacent pixel PX1, so as with the correlation 811, the supplementation dots "L" are arranged in the adjacent pixel PX1 within the designated range A10. In this way, dots for which the size has been changed are included in the dot pattern P1 after supplementation. Also, one characteristic feature of the pattern table TBL4 is that when "LN" and "RN2" within the designated range A10 in the scan direction D2 are "MM" with dots continuous in the scan direction D2, at least a portion of the dots of "RN2" are enlarged. In this case, it is possible that a multiple dot ruled line will extend across the dot omission pixels PXL and the adjacent pixel PX2, so as with the correlation 812, supplementation dots "L" are arranged in the adjacent pixel PX2 within the designated range.

The pattern tables TBLi shown in FIGS. 10 to 14 have as their subject an image forming device for which large dots can only be formed in one of the pixels among two pixels aligned in the scan direction D2 within the designated range A10.

One characteristic feature of the pattern table TBL5 referenced when N1<N2 is that when "LN" and "RN2" within the designated range A10 in the scan direction D2 are "MM" for which dots are continuous in the scan direction D2, at least a portion of the dots of "RN2" are enlarged. In this case, it is possible that a multiple dot ruled line that extends across the dot omission pixel PXL and the adjacent pixel PX2 will be formed, so as with the correlation 821, supplementation dots "L" are arranged on the adjacent pixel PX2 within the designated range A10. When Nsum≤6, N1<N2, and "LN" is "MM," N1≤1. Therefore, it is not possible for both "LN" and "RN1" to be "MM."

Another characteristic feature of the pattern tables TBL4 and TBL5 is that though the process of comparing dot count N1 and dot count N2 is not performed, of the first area A1 and the second area A2, dots to be supplemented are arranged in pixels of the area for which the dot count N1 or N2 is larger. With the pattern table TBL4, supplementation dots are formed as with the correlations 811 and 813 of the adjacent pixel PX1 of the first area A1. When "RN1" is "MM," it is not possible to add medium dots to the adjacent pixel PX1, so at least one medium dot is replaced with a large dot (supplementation dot). In contrast to this, on the adjacent pixel PX2 of the second area A2, except for when a multiple dot ruled line is formed in the pixels including the dot omission pixels PXL, as with the correlation 814, supplementation dots are not formed. In the case of the pattern table TBL5, as with the correlations 821 and 822, supplementation dots are formed in the adjacent pixel PX2 of the second area A2. In contrast to this, in the adjacent pixel PX1 of the first area A1, as with the correlation 823, supplementation dots are not formed.

For the secondary adjacent pixels PX3 and PX4, for example the dot arrangement can be left as is. Also, for example when there is excessive supplementation such as when too much dot supplementation is done due to using an object to be recorded for which the liquid bleeds easily, for example, it is possible to eliminate or reduce a portion of the dots of the secondary adjacent pixels PX3 and PX4. The pattern tables TBL4 and TBL5 shown in FIG. 12 stipulate the correlations for culling dots of the secondary adjacent pixels PX3 and PX4. The "replacement" at the right of "RN3" is the dot arrangement after replacement of the secondary adjacent pixel PX3, and the "replacement" at the right of "RN4" is the dot arrangement after replacement of the secondary adjacent pixel PX4. For example, in the case of the correlation 831, when "LN" is "MM," "RN1" is "MM," and "RN3" is "M0," regardless of the dot arrangement of the pixels PX2 and PX4, the arrangement of the secondary adjacent pixel PX3 after supplementation is "00." "RN2 replacement" and "RN4 replacement" of the pattern table TBL4 are omitted, but can be the same as the "RN2 replacement" and "RN4 replacement" of the pattern table TBL4 shown in FIG. 10. The "RN1 replacement" and "RN3 replacement" of the pattern table TBL5 are omitted, but can also be the same as the "RN1 replacement" and "RN3 replacement" of the pattern table TBL5 shown in FIG. 11.

One characteristic feature of the pattern tables TBL4 and TBL5 shown in FIG. 12 is that the dots of the secondary adjacent pixels PX3 and PX4 adjacent to the adjacent pixels PX1 and PX2 in which supplementation dots "L" are arranged are eliminated. For example, when the supplementation dots "L" become larger by using an object to be recorded for which the liquid bleeds easily or the like, by culling the dots of the secondary adjacent pixels adjacent to the adjacent pixels in which the supplementation dots "L" are arranged, excessive supplementation is suppressed, and the image quality of the output image 330 is improved. In the case of the correlation 831 for which there is a possibility of a multiple dot ruled line in the pattern table TBL4 in FIG. 12, the medium dots of the number 1 secondary adjacent pixel PX3 adjacent to the number 3 pixel in which the large dots are arranged with the adjacent pixel PX1 are culled. In the case of the correlation 832 as well for which there is not a multiple dot ruled line with the pattern table TBL4, the medium dot of the number 1 secondary adjacent pixel PX3 adjacent to the number 3 pixel in which the large dots are arranged with the adjacent pixel PX2 are culled. In the case of the correlation 833 for which it is possible there will be a multiple dot ruled line with the pattern table TBL5, the medium dots of the number 9 secondary adjacent pixel PX4 adjacent to the number 7 pixel in which large dots are arranged with the adjacent pixel PX2 are culled. In the case of the correlation 834 as well which does not have a multiple dot ruled line with the pattern table TBL5, the medium dots of the number 9 secondary adjacent pixel PX4 adjacent to the number 7 pixel in which large dots are arranged after replacement are culled.

When there are originally no dots in the adjacent pixel PX1 with the pattern table TBL4, as with the correlation 835, the dot arrangement of the secondary adjacent pixel PX3 does not change. In a case when there are originally no dots in the adjacent pixel PX2 with the pattern table TBL5, as with the correlation 836, the dot arrangement of the secondary adjacent pixel PX4 does not change. On the other hand, as with the correlation 837 of the pattern table TBL4, the medium dots of the number 1 secondary adjacent pixel PX3 adjacent to the number 3 pixel in which medium dots are arranged can also be culled. As with the correlation 838 of the pattern table TBL5, medium dots of the number 9 secondary adjacent pixel PX4 adjacent to the number 7 pixel in which medium dots are arranged can also be culled.

Also, instead of culling the dots of the secondary adjacent pixels PX3 and PX4, it is also possible to make the dots of the secondary adjacent pixels PX3 and PX4 smaller. For example, with the correlations 831 to 834, 837, and 838 shown in FIG. 12, a portion or all of the dot arrangement of "RN3" and "RN4" after replacement can also be changed to "S0."

Furthermore, when there is a possibility of a multiple dot ruled line being formed as with the pattern tables TBL4 and TBL5 shown in FIGS. 13 and 14, it is also possible to stipulate correlations for which supplementation dots are arranged in the secondary adjacent pixels PX3 and PX4. In the case of the correlation 841 shown in FIG. 13, when "LN" is "MM," and "RN1" is "MM," the "RN1" after replacement stays the same as "MM," and regardless of the dot arrangement of the pixels PX2, PX3, and PX4, the dot arrangement of the secondary adjacent pixel PX3 after supplementation is "MM." In this case, the medium dots newly arranged in the secondary adjacent pixel PX3 are supplementation dots. In the case of the correlation 842 shown in FIG. 13 and the correlation 851 shown in FIG. 14, when "LN" is "MM" and "RN2" is "MM," "RN2" after replacement stays the same as "MM," and regardless of the dot arrangement of the pixels PX1, PX3, and PX4, the dot arrangement of the secondary adjacent pixel PX4 after supplementation is "MM." In this case, the medium dots newly arranged in the secondary adjacent pixel PX4 are supplementation dots.

When the multiple dot ruled line is not formed, for the secondary adjacent pixels PX3 and PX4, the dot arrangement can be left as is, or if it seems there will be excessive supplementation, a portion of the dots can be eliminated or made smaller.

Following, referring to FIGS. 15 through 17, we will describe the operation and effect of the image forming device 1. In the top sections of these drawings, shown are examples of the original image 320 before supplementation of dots that are not actually formed, and in the lower sections are shown examples of the output image 330 after supplementation of dots that are actually formed. The output image 330 is formed as a print image on the object to be recorded 400, for example.

First, FIG. 15 shows an example of, with each designated range A101 to A104, dot supplementation being done for a medium ink duty original image 320 having a two-dot ruled line for which both "LN" and "RN1" are "MM" for which dots are continuous, and the output image 330 is formed. In this case, there is a possibility of a two-dot ruled line being formed with the dot omission pixels PXL and the adjacent pixel PX2, so for any of the designated ranges A101 to A104, large dots which are supplementation dots are formed on the number 3 adjacent pixel PX1 according to the pattern table TBLA shown in FIG. 10.

Figure 20:
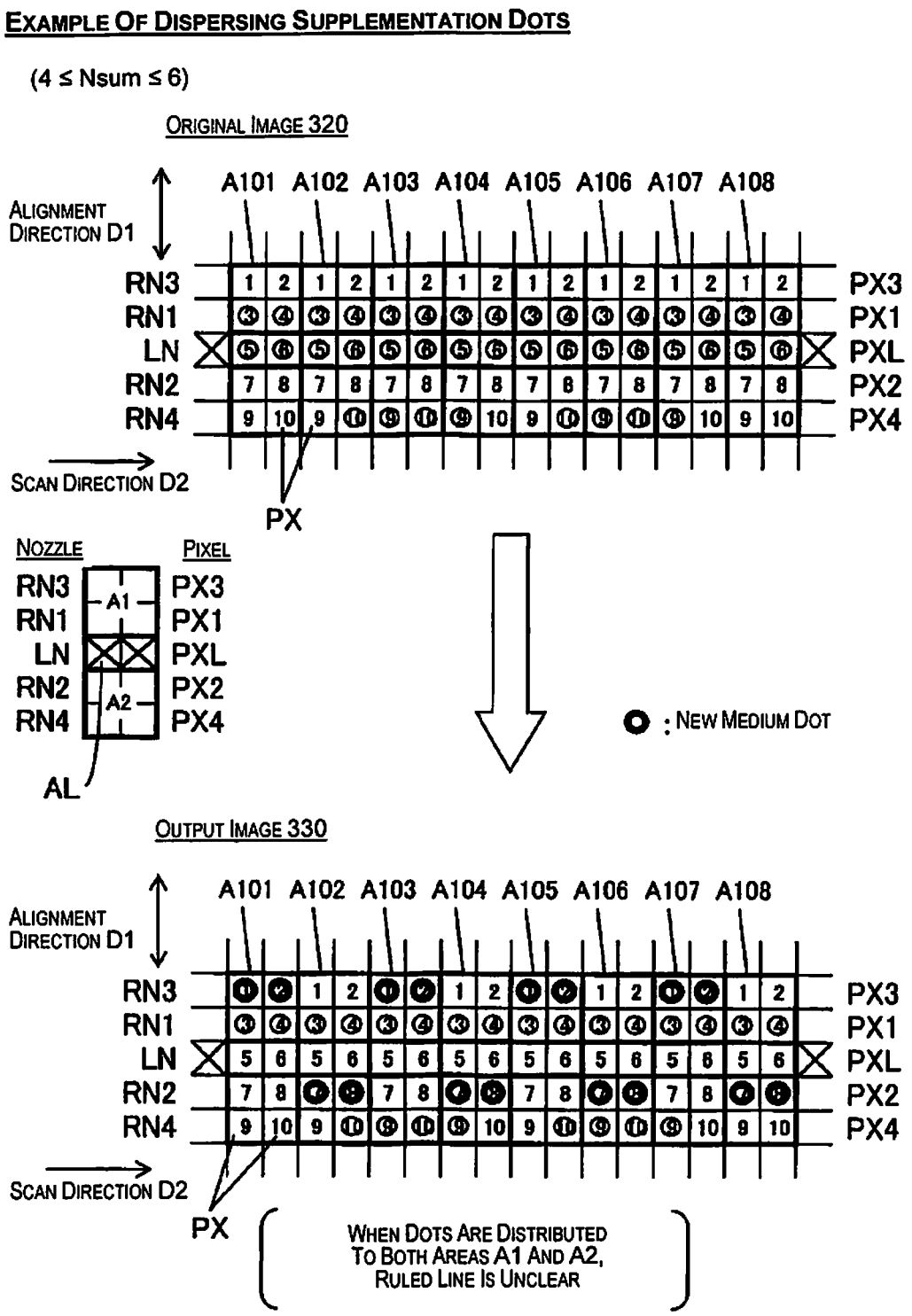
FIG. 20 is a drawing schematically showing an example of a dot pattern P1 with supplementation dots dispersed in areas A1 and A2 when a two-dot ruled line is formed on the dot omission pixels PXL and the adjacent pixels.

Here, we will compare with the example shown in FIG. 20. FIG. 20 shows an example of the supplementation dots being dispersed in the areas A1 and A2 when a two-dot ruled line is formed continuously in the scan direction D2 on the dot omission pixels PXL and the adjacent pixel PX1. With this example, if supplementation dots are formed on the secondary adjacent pixel PX3 of the first area A1, supplementation dots are also formed on the adjacent pixel PX2 of the second area A2. In this case, though there is a one-dot ruled line formed on the adjacent pixel PX1, with the supplementation dots formed on the secondary adjacent pixel PX3 adjacent to this one-dot ruled line and the supplementation dots formed on the adjacent pixel PX2 separated from the one-dot ruled line, the ruled line is unclear. Because of this, the image quality of the output image 330 decreases.

With this technology shown by example in FIG. 15, when dots are formed continuously in the scan direction D2 on the dot omission pixels PXL and the adjacent pixel PX1 within the designated range A10 when according to the recording data 300 before supplementation, at least a portion of the dots formed on the adjacent pixel PX1 within the designated range A10 is made larger. Therefore, with this technology, when there is a possibility of a ruled line of two dots or more being formed on pixels including the dot omission pixels PXL, the part to be formed by the defective nozzle LN among the multiple dot ruled lines is supplemented with the adjacent pixel PX1 of the ruled line part, so the multiple dot ruled line by the nozzles 64 including the defective nozzle LN is more suitably supplemented. Though the illustration is omitted, this is also true in cases when there is a possibility of a ruled line of two dots or greater being formed with the dot omission pixels PXL and the adjacent pixel PX2.

In FIG. 15, shown in parentheses is an example of, when dots are formed continuously in the scan direction D2 with the dot omission pixels PXL and the adjacent pixel PX1 within the designated range A10 when according to the recording data 300 before supplementation, supplementation dots being arranged in the secondary adjacent pixel PX3 and the output image 331 being formed. In this case, for any of the designated ranges A101 to A104, medium dots which are supplementation dots are formed on the secondary adjacent pixel PX3 according to the pattern table TBL4 shown in FIG. 13. When there is a possibility of a ruled line of two dots or more being formed with the dot omission pixels PXL and the adjacent pixel PX1, the part to be formed by the defective nozzle LN of the multiple dot ruled line is supplemented at the secondary adjacent pixel PX3 adjacent to the ruled line part, so with this technology, the multiple dot ruled line by the nozzles 64 including the defective nozzle LN is more suitably supplemented. The same is also true when there is a possibility of a ruled line of two dots or more being formed by the dot omission pixels PXL and the adjacent pixel PX2.

FIG. 16 shows an example of, for each designated range A101 to A104, the medium ink duty original image 320 having a three-dot ruled line for which "LN," "RN1," and "RN2" are "MM" with continuous dots undergoing dot supplementation, and the output image 330 being formed. In this case, there is a possibility of a three-dot ruled line being formed with the dot omission pixels PXL and the adjacent pixels PX1 and PX2, so for any of the designated ranges A101 to A104, the large dots which are supplementation dots are formed on the number 3 and 7 adjacent pixels PX1 and PX2 according to the pattern table TBL4 shown in FIG. 10. Therefore, with this technology, when there is a possibility of a three-dot ruled line being formed on pixels including the dot omission pixels PXL, the part to be formed by the defective nozzle LN of the multiple dot ruled line is supplemented at the adjacent pixels PX1 and PX2 of the ruled line part, so the multiple dot ruled line by the nozzles 64 including the defective nozzle LN is more suitably supplemented.

FIG. 17 shows an example of, with each designated range A101 to A108, dot supplementation of the medium ink duty original image 320 for which "LN" is "M0" or "0M." In this case, a ruled line is not formed on the dot omission pixels PXL, so supplementation dots are formed on pixels of the area for which dot number N1 and dot number N2 is greater among the first area A1 and the second area A2 according to either of the pattern tables TBL4 or TBL5. For example, for the designated range A101, N1≥N2, so the pattern table TBL4 like that shown in FIG. 10 is referenced, and new medium dots are arranged and formed as supplementation clots on the number 4 adjacent pixel PX1 of the first area A1 according to "MM" corresponding to when "LN" is "0M" and "RN1" is "M0." Supplementation dots are not formed in the second area A2. With the designated range A102, N1<N2, so the pattern table TBL5 like that shown in FIG. 11 is referenced, and new medium dots are arranged and formed as supplementation dots on the number 8 adjacent pixel PX2 of the second area A2 according to "MM" corresponding to when "LN" is "0M" and "RN2" is "M0." Supplementation dots are not formed in the first area A1. With the designated range A103, the pattern table TBL4 is referenced, and large dots are arranged and formed on the number 3 adjacent pixel PX1 of the first area A1 according to "LM" corresponding to when "LN" is "0M" and "RN1" is "MM." The large dots are the supplementation dots changed from the medium dots. Supplementation dots are not formed in the second area A2.

When dots are concentrated in the area for which there is a large number of dots among the first area A1 and the second area A2, a pattern P1 of dots after supplementation with a good visual appearance is formed. Therefore, with this technology, dots by the defective nozzle LN are more suitably supplemented, and the image quality of the output image 330 is improved.

(3-4) Low Ink Volume Processing and High Ink Volume Processing

Next, we will describe the process of S208, S216, and S218 in FIG. 8 that are performed when the number of dots Nsum with the designated range A10 is smaller than the first designated number T1=4, or larger than the second designated number T2=6. The pattern tables TBL1, TBL6, and TBL7 referenced during this processing are not illustrated, but the same as with the pattern tables TBL4 and TBL5, correlations are stipulated of dot arrangements before and after supplementation according to the dot arrangement of the dot omission pixels PXL and the adjacent pixels for the neighboring pixels (PX1, PX2, PX3, and PX4) corresponding to the neighboring nozzles (RN1, RN2, RN3, and RN4). For example, we will assume that when "RN1" is "AB" (A and B are respectively 0 or M) for the dot arrangement of a certain "LN," then the dot arrangement after replacement is "CD" (C and D are respectively 0 or M or L). In this case, the image forming device 1 replaces the dot arrangement "AB" of the adjacent pixel PX1 before supplementation with "CD" according to the pattern table TBLi. By using the pattern table TBLi, this technology performs the dot supplementation process quickly, and it is possible to efficiently and suitably supplement dots DT by the defective nozzle LN.

(4) MODIFICATION EXAMPLES

Various modification examples are possible for the present invention.

For example, the image forming device to which this technology can be applied is not limited to being an inkjet printer, and in addition to line printers also includes serial printers, copiers, fax machines and the like.

The ink colors can omit a portion of CMYK, and in addition to CMYK as well, can also include at least a portion of lc (light cyan), lm (light magenta), dy (dark yellow), lk (light black), Or (orange), Or (green), B (blue), V (violet), and the like.

The nozzles that form the dots on the adjacent pixels can also be nozzles other than adjacent nozzles that are adjacent to the defective nozzle in the nozzle alignment direction. For example, with a serial printer, a possibility is a case of forming dots on the adjacent pixels using a nozzle separated from the defective nozzle with a different pass (scan) of the recording head using technology such as a microweave or the like.

The processes described above can be changed as appropriate such as by changing the sequence or the like. For example, with the supplementation process in FIG. 8, the processes of S210 to S212 can also be performed before the processes of S206 to S208.

For each pattern table TBLi, when "LN" is "00," it is possible to stipulate correlations of the neighboring pixels PXR before and after supplementation (correlations for which the dot arrangement does not change, for example). In this case, it is possible to omit the judgment process of S204 in FIG. 8.

In the case of an image forming device for which it is possible to form large dots at both of two pixels aligned in the scan direction D2 within the designated range A10, it is possible to form large dots aligned in the scan direction D2 as the supplementation dots on adjacent pixels or the like.

When the recording data 300 before supplementation is 4-value data, the supplementation process is performed recording the large dots and the small dots expressed by the recording data 300 as medium dots, and the respective original large, medium and small dots can be arranged in areas for which the dot arrangement does not change before and after supplementation.

It is also possible to prepare the pattern tables TBL4 and TBL5 like those shown in FIGS. 10 and 11 and the pattern tables TBL4 and TBL5 like those shown in FIGS. 13 and 14, and to switch the combination of the used pattern tables TBL4 and TBL5 as necessary.

Figure 18A:
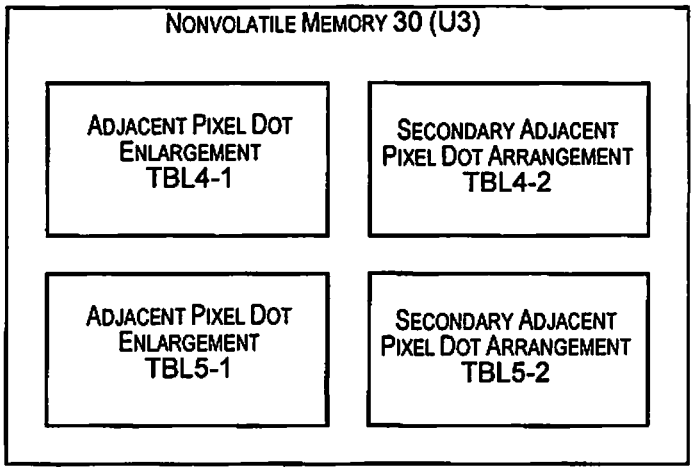
FIG. 18A is a drawing schematically showing an example of providing pattern tables TBLi according to the ruled line supplementation method.

FIG. 18A schematically shows an example of providing pattern tables TBLi according to the ruled line supplementation method. The adjacent pixel dot enlargement pattern table TBL4-1 shown in FIG. 18A is a medium ink volume pattern table for which at least a portion of the dots formed on the adjacent pixel PX1 within the designated range A10 are enlarged when there is a possibility of a multiple dot ruled line with both "LN" and "RN1" being "MM" as shown in FIG. 10. The adjacent pixel dot enlargement pattern table TBL5-1 is a medium ink volume pattern table for which at least a portion of the dots formed on the adjacent pixel PX2 within the designated range A10 are enlarged when there is a possibility of a multiple dot ruled line with both "LN" and "RN2" being "MM" as shown in FIG. 11. The secondary adjacent pixel dot arrangement pattern table TBL4-2 is a medium ink volume pattern table for which supplementation dots are arranged in the secondary adjacent pixel PX3 within the designated range A10 when both "LN" and "RN1" are "MM" as shown in FIG. 13. The secondary adjacent pixel dot arrangement pattern table TBL5-2 is a medium ink volume pattern table for which supplementation dots are arranged in the secondary adjacent pixel PX4 within the designated range A10 when both "LN" and "RN2" are "MM" as shown in FIG. 14.

Figure 19:
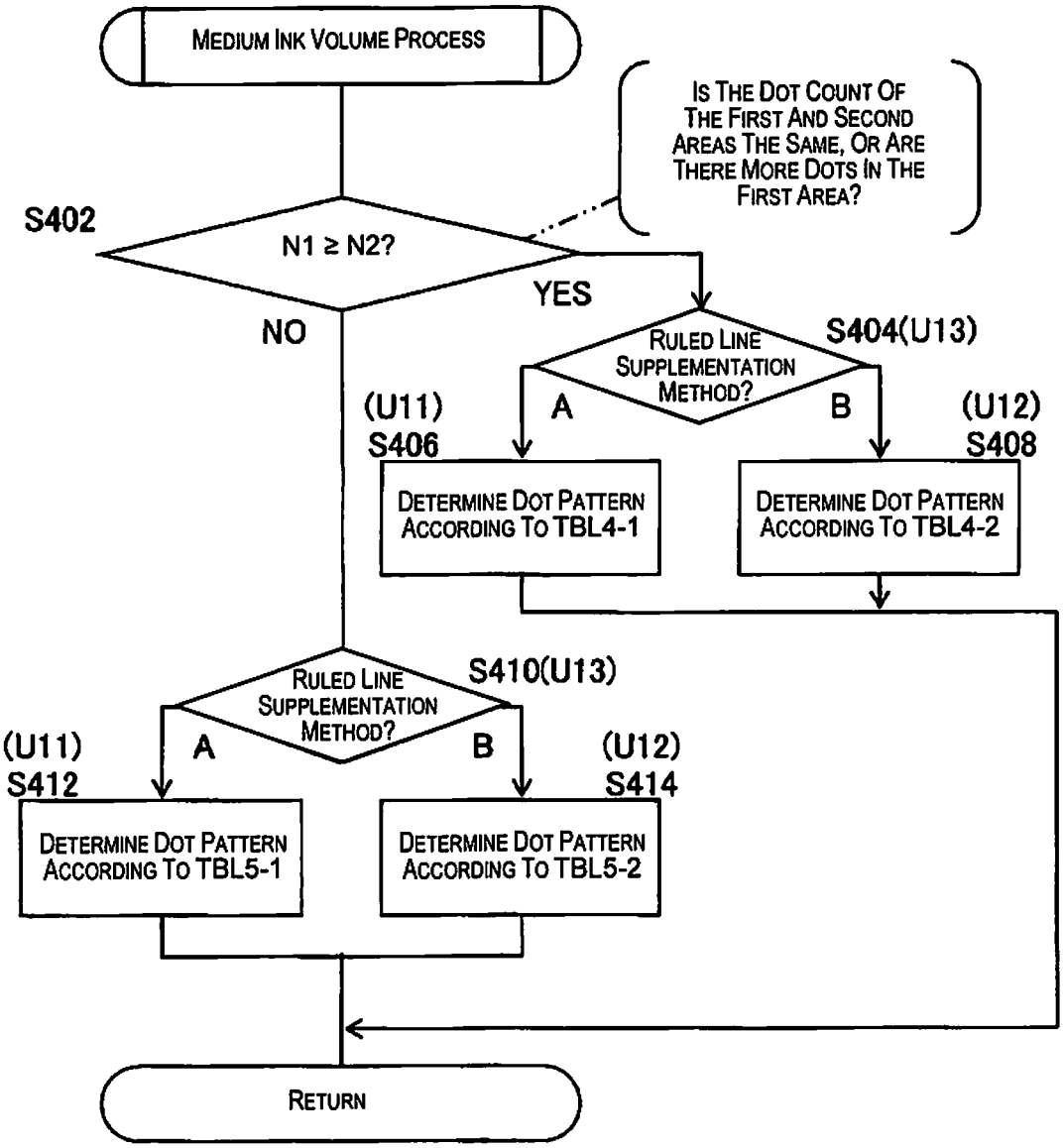
FIG. 19 is a flow chart showing a modification example of medium ink volume processing.

FIG. 19 shows a flow chart of a modification example of the medium ink volume process that can be executed at step S212 in FIG. 8. Here, S406 and S412 correspond to a first pattern determining unit U11 for determining the dot pattern P1 after supplementation so that at least a portion of the dots formed on the adjacent pixels PX1 and PX2 within the designated range A10 are enlarged. S408 and S414 correspond to a second pattern determining unit U12 for determining the dot pattern P1 after supplementation so that dots are arranged in the secondary adjacent pixels PX3 and PX4 within the designated range A10. S404 and S410 correspond to a switching unit U12 that switches whether to determine the dot pattern P1 after supplementation using the first pattern determining unit U11 or to determine it using the second pattern determining unit U12. For example, it is possible to switch the referenced pattern table by when using a first object to be recorded for which ink does not bleed easily such as glossy paper or the like, and when using a second object to be recorded for which ink bleeds easily such as recycled or the like. The level of how difficult it is for ink to bleed or how easy it is to bleed can be expressed by the size of the surface area ratio of the dot DT to the surface area of the pixel PX. In this case, the object to be recorded is an object to be recorded for which the ink is more difficult to bleed the smaller the surface area ratio, and the object to be recorded is easier for ink to bleed the larger the surface area ratio.

As a prerequisite for performing the printing process shown in FIGS. 7 to 9, it is possible for the operating panel 73 controlled by the controller 10 to receive one of the printing modes from among a plurality of printing modes (settings) including a first printing mode (first setting) that forms dots on the first object to be recorded, and a second printing mode (second setting) for forming dots on the second object to be recorded. The first printing mode uses the (A) setting for forming the dot pattern according to the adjacent pixel dot enlargement pattern table. The second printing mode uses the (B) setting for forming the dot pattern according to the secondary adjacent pixel dot arrangement pattern table. The controller 10 stores the information expressing the printing mode received by the operating panel 73 in the RAM 20, for example.

When the medium ink volume processing starts, when N1≥N2 (S402), the controller 10 branches the process according to the set ruled line supplementation method (S404). With the first printing mode, specifically, when (A) is set, the controller 10 determines the dot pattern P1 according to the same adjacent pixel dot enlargement pattern table TBL4-1 as the pattern table TBL4 in FIG. 10 (S406), and ends the medium ink volume processing. In this case, when both "LN" and "RN1" are "MM," as shown in FIG. 15, large dots are formed as supplementation dots in at least part of the adjacent pixel PX1 within the designated range A10. In contrast to this, with the second print mode, specifically, when (B) is set, the controller 10 determines the dot pattern P1 according to the same adjacent pixel dot enlargement pattern table TBL5-1 as the pattern table TBL5 in FIG. 11 (S408), and ends the medium ink volume processing. In this case, when both "LN" and "RN1" are "MM," as shown in the parentheses in FIG. 15, medium dots are formed as supplementation dots in the secondary adjacent pixel PX3 within the designated range A10.

When N1<N2, the controller 10 branches the process according to the set ruled line supplementation method (S410). Specifically, when (A) is set, the controller 10 determines the dot pattern P1 according to the same secondary adjacent pixel dot arrangement pattern table TBL4-2 as the pattern table TBL4 in FIG. 13 (S412), and ends the medium ink volume processing. In this case, when both "LN" and "RN2" are "MM," large dots are formed as supplementation dots for at least a portion of the adjacent pixel PX2 within the designated range A10. In contrast to this, with the second print mode, specifically, when (B) is set, the controller 10 determines the dot pattern P1 according to the same secondary adjacent pixel dot arrangement pattern table TBL5-2 as the pattern table TBL5 in FIG. 14 (S414). In this case, when both "LN" and "RN2" are "MM," medium dots are formed as supplementation dots in the secondary adjacent pixel PX4 within the designated range A10.

With this modification example, when supplementing multiple dot ruled lines to be formed on pixels including dot omission pixels PXL, it is possible to switch whether to enlarge at least a portion of dots formed on the adjacent pixels PX1 and PX2 within the designated range A10 or to arrange dots in the secondary adjacent pixels PX3 and PX4 within the designated range A10 according to the settings. Therefore, the multiple dot ruled lines by the nozzles 64 including the defective nozzle LN are even more suitably supplemented.

Figure 18B:
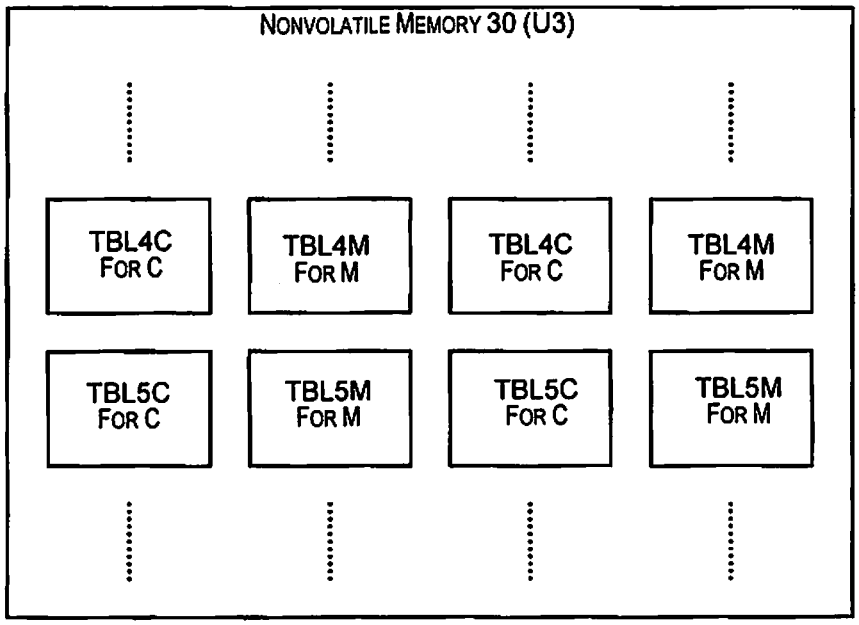
FIG. 18B is a drawing schematically showing an example of providing pattern tables TBLi according to the ink color.

Also, as shown with the example in FIG. 18B, the pattern tables TBLi can also be provided according to the ink color so that the dot arrangement is according to the color of the ink (liquid). In the nonvolatile memory 30 shown in FIG. 18B, shown are the pattern tables TBL1, TBL4, TBL5, TBL6, and TBL7 described above having the pattern tables stored divided respectively into CMYK. With the example in FIG. 18B, as the medium ink volume pattern table TBL4, shown is the provision of the pattern table TBL4C for dot supplementation of the cyan recording data 300, the pattern table TBL4M for dot supplementation of the magenta recording data 300, pattern table TBL4Y for dot supplementation of the yellow recording data 300, and pattern table TBL4K for dot supplementation of the black recording data 300. As the medium ink volume pattern table TBL5, shown is the provision of pattern tables TBL5C, TBL5M, TBL5Y, and TBL5K. This modification example can do even more suitable supplementation of dots by the defective nozzle LN according to the color of the liquid.

Of course, pattern tables can also be provided according to the type of object to be recorded for each type of object to be recorded or the like, or can be provided according to the resolution of the output image. In that case, suitable dot supplementation is performed according to the type of image to be recorded or the resolution of the output image.

Even with the image forming device without the defective nozzle detection unit U5 and the setting receiving unit U4, the basic effects of this technology can be obtained.

Also, even when the process is not branched according to the number of dots Nsum to be formed on the pixels within the designated range A10, it is possible to obtain the basic effects of this technology. For example, when both "LN" and "RN1" (or "RN2") are "MM," Nsum≥4, so a judgment of whether or not N≥4 is unnecessary from the point of supplementing multiple dot ruled lines. Also, even when Nsum>6, as a simple process, if both "LN" and "RN1" (or "RN2") are "MM," it is also possible to form supplementation dots of the "MM" part on at least one of the adjacent pixels and the secondary adjacent pixels.

(5) CONCLUSION

As described above, with the present invention, using various modes, it is possible to provide technology that makes it possible to more suitably supplement dots by the defective nozzles for which dot formation is defective. Of course, even with technology consisting only of the constituent elements of the independent claims without having the constituent elements of the dependent claims, the basic operation and effects described above can be obtained.

Also, it is also possible to implement a constitution for which each constitution disclosed in the embodiments and modification examples described above are mutually exchanged, or the combination is changed, or a constitution for which each constitution of known technology as well as that disclosed in the embodiments and modification examples described above are mutually replaced or the combination is changed. The present invention also includes these constitutions and the like.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only a selected embodiment has been chosen to illustrate the present invention, it will be apparent to those skilled in the art from this disclosure that various changes and modifications can be made herein without departing from the scope of the invention as defined in the appended claims. Furthermore, the foregoing descriptions of the embodiment according to the present invention are provided for illustration only, and not for the purpose of limiting the invention as defined by the appended claims and their equivalents.

What is claimed is:

1. An image forming device in which a plurality of nozzles aligned in a designated alignment direction and an object to be recorded are moved relative to each other in a scan direction different from the alignment direction, wherein a plurality of pixels constituting a formed image includes dot omission pixels continuous in the scan direction by a defective nozzle included in the plurality of nozzles, adjacent pixels that are adjacent to the dot omission pixels in the alignment direction, and secondary adjacent pixels that are adjacent to the adjacent pixels at positions on a side opposite to the dot omission pixels from the adjacent pixels, the image forming device comprising:

a pattern determining unit, in response to determining that dots are formed continuously in the scan direction on the dot omission pixels within a designated range in the scan direction based on recording data before supplementation of dots by the defective nozzle, and in response to determining that dots are formed continuously in the scan direction on the adjacent pixels within the designated range based on the recording data, configured to determine a dot pattern after supplementation for the plurality of pixels based on the recording data such that the dot pattern after supplementation is indicative of at least one of enlarging at least a portion of dots formed on the adjacent pixels within the designated range, and arranging dots in the secondary adjacent pixels within the designated range regardless of dot arrangement of the secondary adjacent pixels according to the recording data before supplementation of dots; and a pattern forming unit configured to form the dot pattern after supplementation.

2. The image forming device according to claim 1, wherein the plurality of pixels includes neighboring pixels that are within a designated distance in the alignment direction from the dot omission pixels, when the total number of the dot omission pixels and the neighboring pixels within the designated range is Nmax, the pattern determining unit, when the number Nsum of dots to be formed on the dot omission pixels and the neighboring pixels within the designated range in the scan direction when according to the recording data is a first designated number T1 or greater (T1>0) and a second designated number T2 or less (T1<T2<Nmax), the dots are formed continuously in the scan direction in the dot omission pixels within the designated range in the scan direction when according to the recording data, and the dots are formed continuously in the scan direction in the adjacent pixels within the designated range, configured to determine the dot pattern after supplementation so that at least one of enlarging at least the portion of the dots formed on the adjacent pixels within the designated range, and arranging the dots in the secondary adjacent pixels within the designated range is performed.

3. The image forming device according to claim 1, wherein the plurality of pixels includes neighboring pixels within a designated distance in the alignment direction from the dot omission pixels, the designated range that includes the dot omission pixels and the neighboring pixels includes a first area and a second area sandwiching the dot omission pixels in the alignment direction, and the pattern determining unit is configured to determine the dot pattern after supplementation such that at least one of enlarging at least the portion of the dots formed in the adjacent pixels in a subject area that is an area for which, of the first area and the second area, the number N1 of dots to be formed in the pixels of the first area when according to the recording data or the number N2 of dots to be formed in the pixels of the second area when according to the recording data is larger, and arranging dots in the secondary adjacent pixels of the subject area is performed.

4. The image forming device according to claim 1, wherein the pattern determining unit has a first pattern determining unit that is configured to determine the dot pattern after supplementation so as to enlarge at least the portion of the dots formed on the adjacent pixels within the designated range, a second pattern determining unit that is configured to determine the dot pattern after supplementation so that dots are arranged in the secondary adjacent pixels within the designated range, and a switching unit that is configured to switch whether the dot pattern after supplementation is to be determined by the first pattern determining unit or determined by the second pattern determining unit.

5. An image forming device in which a plurality of nozzles aligned in a designated alignment direction and an object to be recorded are moved relative to each other in a scan direction different from the alignment direction, wherein a plurality of pixels constituting a formed image includes dot omission pixels continuous in the scan direction by a defective nozzle included in the plurality of nozzles, and neighboring pixels that are within a designated distance in the alignment direction from the dot omission pixels, and a designated range including a portion of the dot omission pixels and a portion of the neighboring pixels includes a first area and a second area sandwiching the dot omission pixels in the alignment direction, where the total number of the dot omission pixels and the neighboring pixels within the designated range is Nmax, the image forming device comprising:

a pattern determining unit, in response to determining the number Nsum of dots to be formed on the pixels within the designated range based on the recording data before supplementation of dots by the defective nozzle is a first designated number T1 or greater (T1>0) and a second designated number T2 or less (T1<T2<Nmax), configured to determine a dot pattern after supplementation for the plurality of pixels based on the recording data such that the dots to be supplemented are arranged in the pixels of an area for which, of the first area and the second area, the number N1 of dots to be formed in the pixels of the first area based on the recording data, or the number N2 of dots to be formed in the pixels of the second area based on the recording data is larger; and a pattern forming unit configured to form the dot pattern after supplementation.

6. A dot pattern determining method for an image forming device in which a plurality of nozzles aligned in a designated alignment direction and an object to be recorded are moved relative to each other in a scan direction different from the alignment direction, wherein a plurality of pixels constituting a formed image includes dot omission pixels continuous in the scan direction by a defective nozzle included in the plurality of nozzles, adjacent pixels that are adjacent to the dot omission pixels in the alignment direction, and secondary adjacent pixels that are adjacent to the adjacent pixels at positions on a side opposite to the dot omission pixels from the adjacent pixels, the dot pattern determining method comprising:

in response to determining that dots are formed continuously in the scan direction on the dot omission pixels within a designated range in the scan direction based on the recording data before supplementation of dots by the defective nozzle, and in response to determining that dots are formed continuously in the scan direction on the adjacent pixels within the designated range based on the recording data, determining a dot pattern after supplementation for the plurality of pixels based on the recording data such that the dot pattern after supplementation is indicative of at least one of enlarging at least a portion of dots formed on the adjacent pixels within the designated range, and arranging dots in the secondary adjacent pixels within the designated range regardless of dot arrangement of the secondary adjacent pixels according to the recording data before supplementation of dots.

* * * * *